US011674739B2

(12) United States Patent
Kim et al.

(10) Patent No.: US 11,674,739 B2
(45) Date of Patent: Jun. 13, 2023

(54) ENTRANCE REFRIGERATOR

(71) Applicant: LG ELECTRONICS INC., Seoul (KR)

(72) Inventors: Daewoong Kim, Seoul (KR); Minkyu Oh, Seoul (KR); Boan Kwon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 185 days.

(21) Appl. No.: 16/886,209

(22) Filed: May 28, 2020

(65) Prior Publication Data

US 2021/0207875 A1 Jul. 8, 2021

(30) Foreign Application Priority Data

Jan. 2, 2020 (KR) ..... 10-2020-0000074

(51) Int. Cl.
*F25D 21/04* (2006.01)
*F25D 21/14* (2006.01)
*F25D 23/02* (2006.01)

(52) U.S. Cl.
CPC ..... *F25D 21/04* (2013.01); *F25D 21/14* (2013.01); *F25D 23/028* (2013.01); *F25D 2317/0672* (2013.01); *F25D 2600/04* (2013.01)

(58) Field of Classification Search
CPC ..... F25D 21/04; F25D 21/14; F25D 23/028; F25D 2317/0672; F25D 2600/04; F25D 23/003; F25D 23/087; F25D 23/10; F25D 17/06; F25D 2317/068; F25D 2321/141; F25D 2500/02; F25D 15/00; F25D 21/125; F25D 23/065; F25B 2321/0251; F25B 21/02; G07F 17/12; F28F 13/06
See application file for complete search history.

(56) References Cited

U.S. PATENT DOCUMENTS

| | | | | |
|---|---|---|---|---|
| 3,673,735 | A | 7/1972 | Winsler et al. | |
| 6,173,575 | B1 * | 1/2001 | Hall et al. | B26D 1/00 62/3.2 |
| 2005/0120738 | A1 | 6/2005 | Chun et al. | |
| 2005/0210884 | A1 | 9/2005 | Tuskiewicz et al. | |
| 2006/0000221 | A1 | 1/2006 | Culp et al. | |
| 2007/0125100 | A1 | 6/2007 | Shoenfeld | |

(Continued)

FOREIGN PATENT DOCUMENTS

| | | |
|---|---|---|
| CA | 2 461 635 A1 | 9/2005 |
| CN | 85 1 09180 A | 5/1986 |

(Continued)

OTHER PUBLICATIONS

WO-2018073990-A1 Translation (Year: 2018).*

(Continued)

*Primary Examiner* — Elizabeth J Martin
*Assistant Examiner* — Dario Antonio Deleon
(74) *Attorney, Agent, or Firm* — Birch, Stewart, Kolasch & Birch, LLP

(57) ABSTRACT

An entrance refrigerator includes a condensation removal device supplying heat dissipation air generated from a cold air supply module to an outer gasket or an inner gasket to prevent condensation formation on surfaces of the outer gasket and the inner gasket or an outer circumferential surface of a cabinet.

10 Claims, 26 Drawing Sheets

(56) References Cited

U.S. PATENT DOCUMENTS

| | | | | |
|---|---|---|---|---|
| 2010/0043472 | A1* | 2/2010 | Iguchi et al. | A47F 3/04 62/255 |
| 2011/0283727 | A1 | 11/2011 | Gracie | |
| 2015/0338155 | A1 | 11/2015 | Heinzle et al. | |
| 2017/0292768 | A1 | 10/2017 | Yang | |
| 2018/0142935 | A1 | 5/2018 | Jacobi | |
| 2018/0238603 | A1 | 8/2018 | Takami et al. | |
| 2018/0274825 | A1* | 9/2018 | Choi et al. | F25B 21/02 |
| 2018/0363969 | A1 | 12/2018 | Jacobi | |
| 2019/0056165 | A1* | 2/2019 | Im et al. | F25D 17/06 |
| 2019/0178559 | A1 | 6/2019 | Lee et al. | |
| 2019/0186806 | A1 | 6/2019 | Oh | |
| 2019/0226750 | A1* | 7/2019 | Kang et al. | F25D 21/02 |
| 2019/0231106 | A1 | 8/2019 | Kaiserman et al. | |
| 2019/0282015 | A1 | 9/2019 | High et al. | |
| 2019/0335921 | A1 | 11/2019 | Jakobsen | |
| 2019/0368801 | A1* | 12/2019 | Song | F25D 17/08 |
| 2020/0018526 | A1 | 1/2020 | Oh et al. | |

FOREIGN PATENT DOCUMENTS

| | | | | | |
|---|---|---|---|---|---|
| CN | 101653330 | A | | 2/2010 | |
| CN | 105556222 | A | | 5/2016 | |
| CN | 107270643 | A | * | 10/2017 | F25D 23/12 |
| CN | 107461986 | A | | 12/2017 | |
| CN | 107883643 | A | | 4/2018 | |
| CN | 108458534 | A | | 8/2018 | |
| CN | 108626932 | A | | 10/2018 | |
| CN | 108800712 | A | | 11/2018 | |
| CN | 109269189 | A | | 1/2019 | |
| CN | 109838968 | A | | 6/2019 | |
| CN | 110017643 | A | | 7/2019 | |
| CN | 209669273 | U | | 11/2019 | |
| DE | 88 06 978 | U1 | | 8/1988 | |
| DE | 10 2009 001 825 | A1 | | 9/2022 | |
| EP | 0920686 | A1 | | 6/1999 | |
| EP | 2 924 376 | A | | 9/2015 | |
| EP | 3 301 385 | A1 | | 4/2018 | |
| EP | 3 511 663 | A1 | | 7/2019 | |
| GB | 2 167 544 | A | | 5/1986 | |
| JP | 3-140776 | A | | 6/1991 | |
| JP | 10-245095 | A | | 9/1998 | |
| JP | 2000-227271 | A | | 8/2000 | |
| JP | 2000227271 | A | * | 8/2000 | F25D 21/04 |
| JP | 2001-41639 | A | | 2/2001 | |
| JP | 2008-32316 | A | | 2/2008 | |
| JP | 2009-79878 | A | | 4/2009 | |
| JP | 2016-130609 | A | | 7/2016 | |
| JP | WO-2018073990 | A1 | * | 4/2018 | F25D 19/00 |
| KR | 20-0357547 | Y1 | | 7/2004 | |
| KR | 200357547 | Y1 | * | 7/2004 | F25D 11/00 |
| KR | 10-0828045 | B1 | | 5/2008 | |
| KR | 10-2013-0017001 | A | | 2/2013 | |
| KR | 10-2013-0071669 | A | | 7/2013 | |
| WO | WO 2017/197304 | A1 | | 11/2017 | |
| WO | WO 2018/073990 | A1 | | 4/2018 | |
| WO | WO 2018/169178 | A1 | | 9/2018 | |

OTHER PUBLICATIONS

CN-107270643-A Translation (Year: 2017).*
KR-200357547-Y1 Translation (Year: 2004).*
JP-2000227271-A Translation (Year: 2000).*

* cited by examiner

ENTRANCE REFRIGERATOR

CROSS-REFERENCE TO RELATED APPLICATIONS

This application claims the priority benefit of the Korean Patent Application No. 10-2020-0000074 filed in the Republic of Korea on Jan. 2, 2020, which is hereby incorporated by reference as if fully set forth herein.

BACKGROUND

Field of the Invention

The present disclosure relates to an entrance refrigerator. That is, the present disclosure is directed to a refrigerator provided at an entrance to a building, such as a residence.

Discussion of the Related Art

Recently, delivery services for delivering articles (or goods) to a certain place has been commonplace. In particular, when the article to be delivered is fresh food, the fresh food may be stored and delivered in a refrigerator or in a warmer, the refrigerator or warmer may be provided in a delivery vehicle, in order to prevent the food from being spoiled or cooled.

Food is generally delivered in a packing material to maintain a cooling or warming state. The packing material is formed of environmental pollutants, such as Styrofoam® or an extruded polystyrene foam or other insulating material. There is an increasing need to reduce the environmental pollutants, including socially and economically.

Additionally, if a user is at home at a delivery time, the user may directly receive food from a courier (i.e., a delivery person) face to face, but if the user is not at home, such as when the delivery time is too early or late, it may be difficult for the user to directly receive food from the courier face to face.

Therefore, there is a need for food to be received even if the user does not come into direct contact with a courier and there is a need for food not to be spoiled or to be overly cooled until the food is finally delivered to the user. That is, there is a need to maintain the food in the manner in which it was delivered, including the temperature it was delivered, in order to preserve its freshness or to keep the food at a desired temperature for consumption.

In order to solve these above problems, recently, a product, such as a refrigerator, is installed at an entrance (e.g., front door) of a user's residence or other place, so that the courier may store the delivered food in the refrigerator to keep the food fresh and the user may access the refrigerator at a convenient time to receive the food.

A related art below discloses an entrance refrigerator provided to be mounted on an entrance door or embedded (e.g., provided) in a wall that borders an entrance hallway.

Related art: Korean Utility Model Registration No. 20-0357547, dated Jul. 19, 2004.

The entrance refrigerator embedded (e.g., provided) in a wall disclosed in the related art has the following problems.

In detail, when the storage compartment of the entrance refrigerator is maintained at or below a refrigerating temperature, a temperature difference occurs between the inside and the outside of the storage compartment, and the temperature difference may be significant, especially in summer.

When an internal temperature of the storage compartment is lower than an outdoor temperature, condensation may occur at edges of a rear surface of an outdoor side door, due to a temperature difference between the inside and the outside of the storage compartment. Condensate water formed on the edges of the rear surface of the outdoor side door flows down by gravity and eventually falls to the floor of the outer corridor of the entrance door.

In summer, although an indoor temperature is kept lower than an outdoor temperature, a temperature of the storage compartment of the entrance refrigerator kept at or below a refrigerating temperature is significantly different from an indoor temperature.

In addition, when the internal temperature of the storage compartment is lower than an indoor temperature, condensation may occur on a door of the entrance refrigerator, including at edges of a rear surface of an indoor side door, due to a temperature difference between the inside and the outside of the storage compartment. The condensate water formed on the entrance refrigerator (including edges of the rear surface of the indoor side door) flows down by gravity and eventually falls to the floor of an entrance.

When condensate water flows down to the floor of the entrance or the outer corridor, the floor can get dirty more quickly and there is a greater risk of a falling or slipping accident for a person walking past the corridor or entrance.

In the case of a general refrigerator installed in a kitchen, a separate heater may be embedded in a cabinet or a hot gas pipe branched from a discharge port of a compressor may be embedded in the cabinet in order to prevent condensation from forming on the back of a refrigerator door.

However, installing a separate heater in the entrance refrigerator increases power consumption of the entrance refrigerator.

In addition, a hot gas pipe cannot be installed in an entrance refrigerator that employs a thermoelectric module, rather than a refrigerating cycle, as a cold air supply module (e.g., assembly, unit).

SUMMARY

To achieve these and other advantages and in accordance with the purpose of the disclosure, as embodied and broadly described herein, there is provided an entrance refrigerator having a structure in which a cold air supply module (e.g., assembly, unit) is mounted on a rear surface of a cabinet, and a portion of the cold air supply module is covered by a heat dissipation cover.

A condensation removal device may be coupled to at least one side of a left surface and a right surface of the heat dissipation cover.

A first gasket (e.g., outer gasket) may be mounted in a first opening (front opening) provided on a front surface of the cabinet, and a second gasket (e.g., inner gasket) may be mounted in a second opening (side opening) provided on the side surface of the cabinet, and an end of the condensation removal device is provided in at least one of the first opening and the second opening.

The condensation removal device may include a guide duct extending from a side surface of the heat dissipation cover, a side duct extending from the guide duct, and a cover duct connected to an end of the side duct.

The cover duct may be mounted in the cabinet corresponding to a rear of the first gasket or a rear of the second gasket, and specifically, on a rear surface of a flange of an inner case forming the cabinet.

The flange portion of the inner case covered by the cover duct may have a plurality of air holes to supply heat emitted from the heat dissipation cover to the first gasket or the second gasket.

The entrance refrigerator according to the embodiment of the present disclosure configured as described above has the following effects.

First, outdoor air, having a temperature increased due to heat exchange with a heat sink of the cold air supply module, may evaporate condensation formed on the surface of the outer gasket installed at the edge of the rear surface of the outdoor side door and the inner gasket installed at the edge of the rear surface of the indoor side door. That is, the cold air supply module includes a heat sink to evaporate condensation, including condensation formed on the back of the entrance refrigerator.

Second, since the heat sink evaporates the condensation, without having to embed a separate heater for evaporating condensation, power consumption may be reduced.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION OF THE DISCLOSURE

Hereinafter, an entrance refrigerator according to embodiments of the present disclosure will be described in detail with reference to the accompanying drawings.

Figure 1:
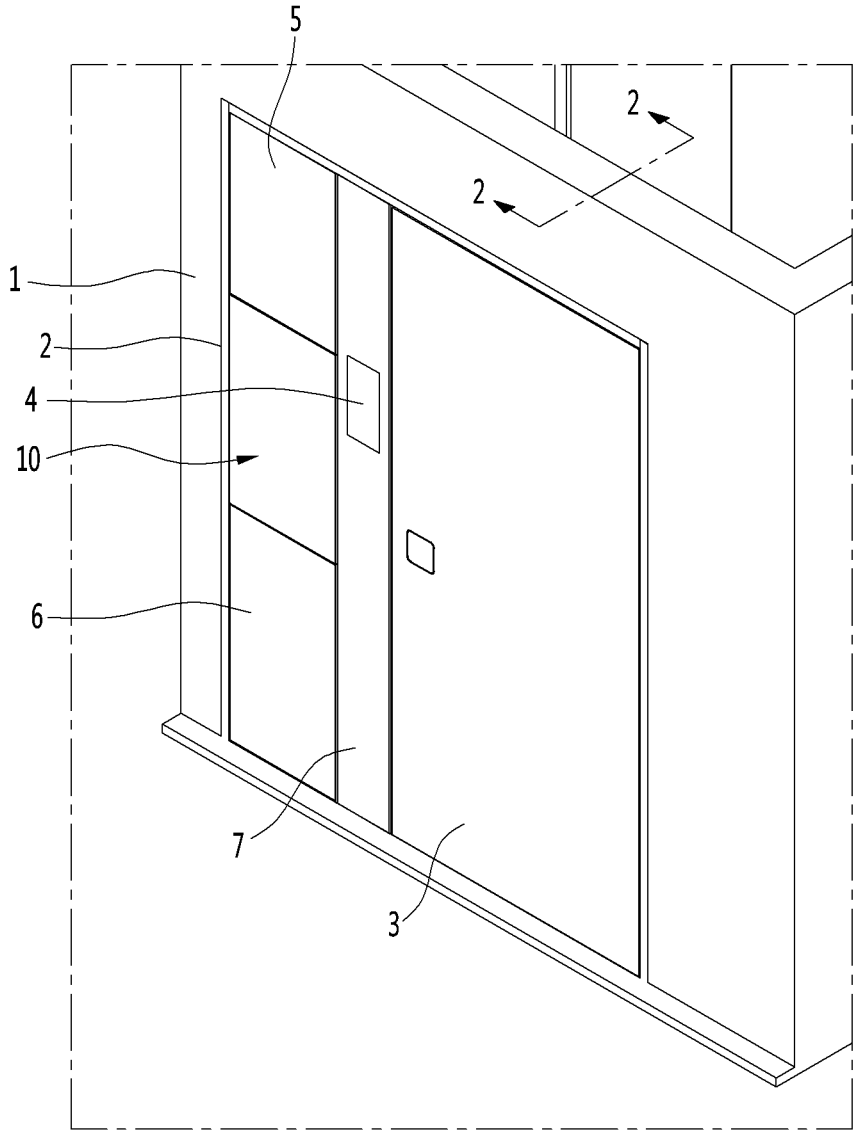
FIG. 1 is a front perspective view of an entrance equipped with an entrance refrigerator according to an embodiment of the present disclosure.
Figure 2:
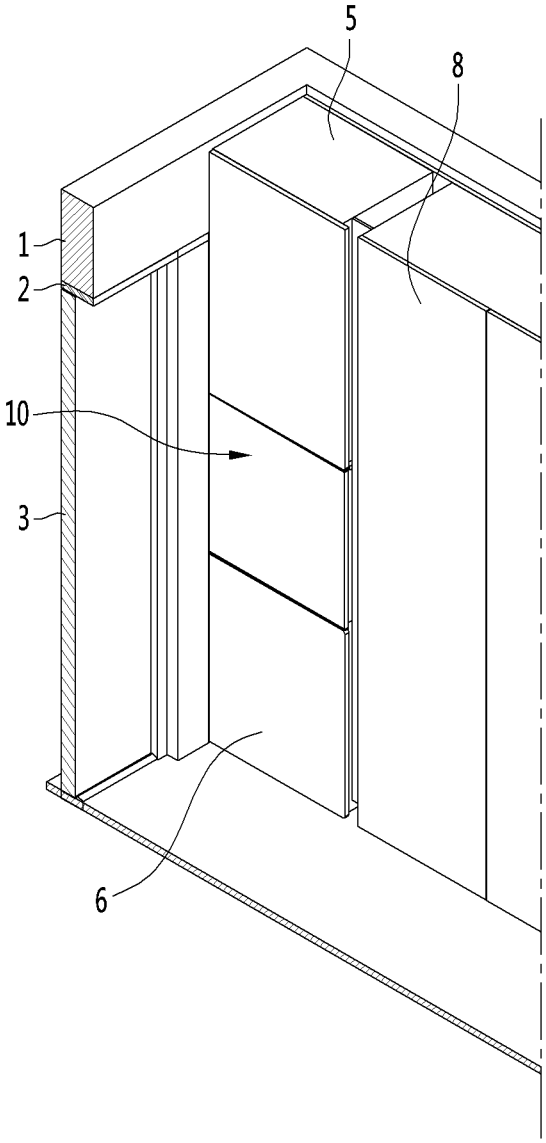
FIG. 2 is a perspective view showing the inside of an entrance taken along line 2-2 of FIG. 1.

FIG. 1 is a front perspective view of an entrance equipped with an entrance refrigerator according to an embodiment of the present disclosure, and FIG. 2 is a cutaway perspective view showing an inside of an entrance taken along line 2-2 of FIG. 1.

Referring to FIGS. 1 and 2, an opening is formed on an outer wall 1 partitioning an indoor area and a corridor, and a frame 2 is provided at the edge of the opening. That is, the frame 2 is attached to the opening of the outer wall 1. In addition, an entrance door 3 may be installed inside the frame 2, and an entrance refrigerator 10 may be disposed on a side of the entrance door 3 (e.g., the entrance refrigerator 10 may be positioned within the frame and adjacent to the entrance door 3).

A partition or a partition wall 7 may be formed between the entrance door 3 and the entrance refrigerator 10, and the partition 7 opens and closes the entrance door 3, which may be a front door. The partition 7 may have a control panel 4 for controlling opening and closing of the entrance door 3 and opening and closing of a door 12 (see FIG. 3) of the entrance refrigerator 10.

The control panel 4 may include at least one of a face recognition sensor for recognizing a face of an approaching person, a code reader for recognizing an encryption code of a delivery service article to be stored in the entrance refrigerator 10, a proximity sensor, a controller (e.g., processor, CPU) and a display unit. Further, the at least one face recognition sensor, the code reader, and the proximity sensor of the code reader 4 may be installed at one side or multiple sides of the control panel 4. A face image of an approaching person, recognized by the face recognition sensor, may be displayed on the display unit of the control panel 4.

In addition, a controller of the control panel 4 may perform a function of controlling opening and closing of an outdoor side door and an indoor side door of the entrance refrigerator 10, as well as a function of controlling opening and closing of the entrance door 3, according to a result of the face recognition.

For example, the controller of the control panel 4 may perform a function of opening an outdoor side door of the entrance refrigerator 10 according to a result of recognizing a delivery article and automatically perform a function of locking the outdoor side door when the outdoor side door is recognized to be closed.

In addition, in a state where one of the outdoor side door and an indoor side door of the entrance refrigerator 10 is open, the controller of the control panel 4 may maintain the other in a closed state.

Alternatively, an independent control panel may be provided for performing the functions on the indoor side door of the entrance refrigerator or the outdoor side door of the entrance refrigerator 10 described above with respect to the control panel 4.

Additionally, an upper side (e.g., upper portion) of the entrance refrigerator 10 may be provided with a first storage 5, and a lower side (e.g., lower portion) thereof, below the first storage 5, may be provided with a second storage 6. The first storage 5 may function as a warmer for storing articles in a warmed state. In addition, the second storage 6 may be maintained at room temperature to simply perform a function of storing a delivery service article (e.g., an article not needing to be maintained a particular temperature) or may be maintained at a temperature different from an internal temperature of the entrance refrigerator 10. Alternatively, the second storage may be maintained at a temperature lower than room temperature.

The first storage 5 may be maintained at a refrigerating temperature or freezing temperature, and the second storage 6 may be used as a space maintained at room temperature so as to perform only a function of storing a delivery service article.

Additionally, one or a plurality of third storages 8 may be installed on an indoor entrance side wall corresponding to a rear of the entrance refrigerator 10. The third storage 8 may be adjacent to the first storage 5 and the second storage 6, including between the first storage 5 and the entrance door 3 and between the second storage 6 and the entrance door 3. The third storage 8 may be used as a space for storing shoes, umbrellas, or laundry.

Figure 3:
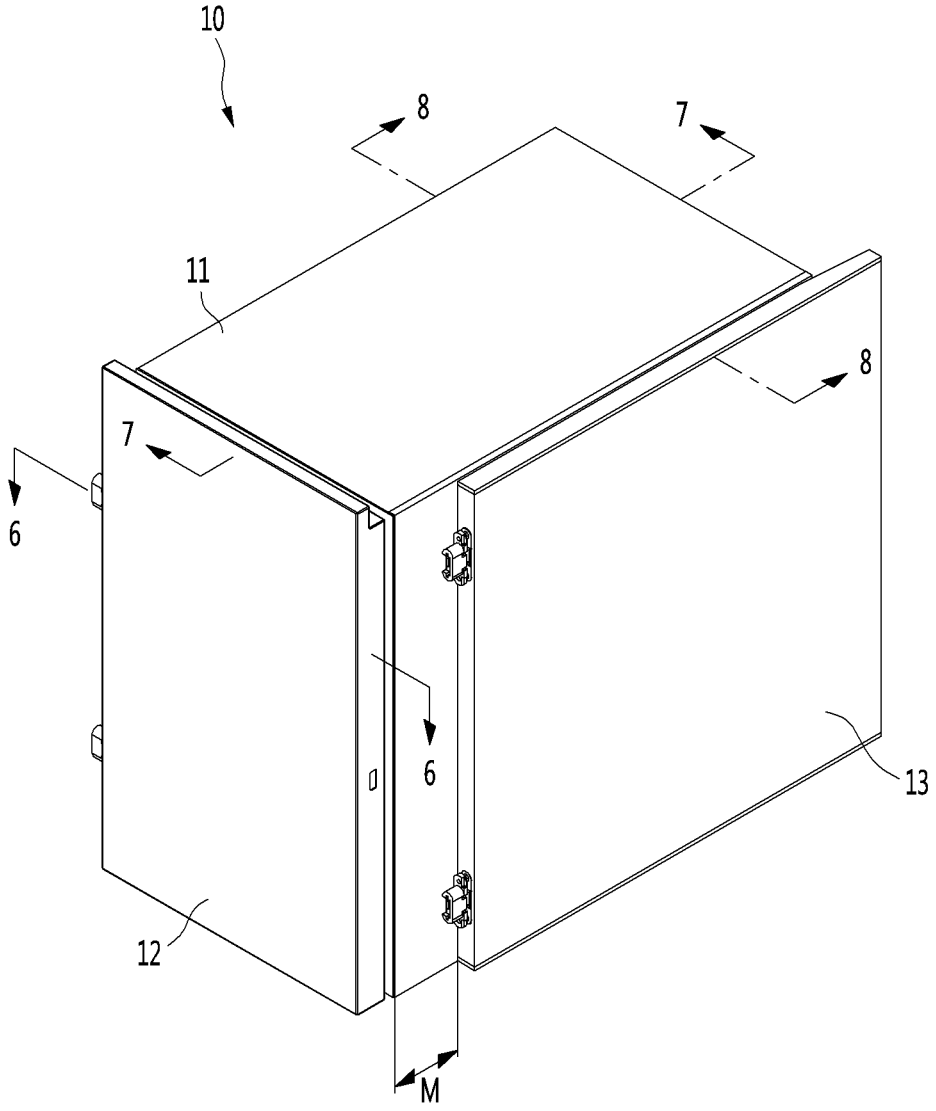
FIG. 3 is a front perspective view of an entrance refrigerator according to an embodiment of the present disclosure.
Figure 4:
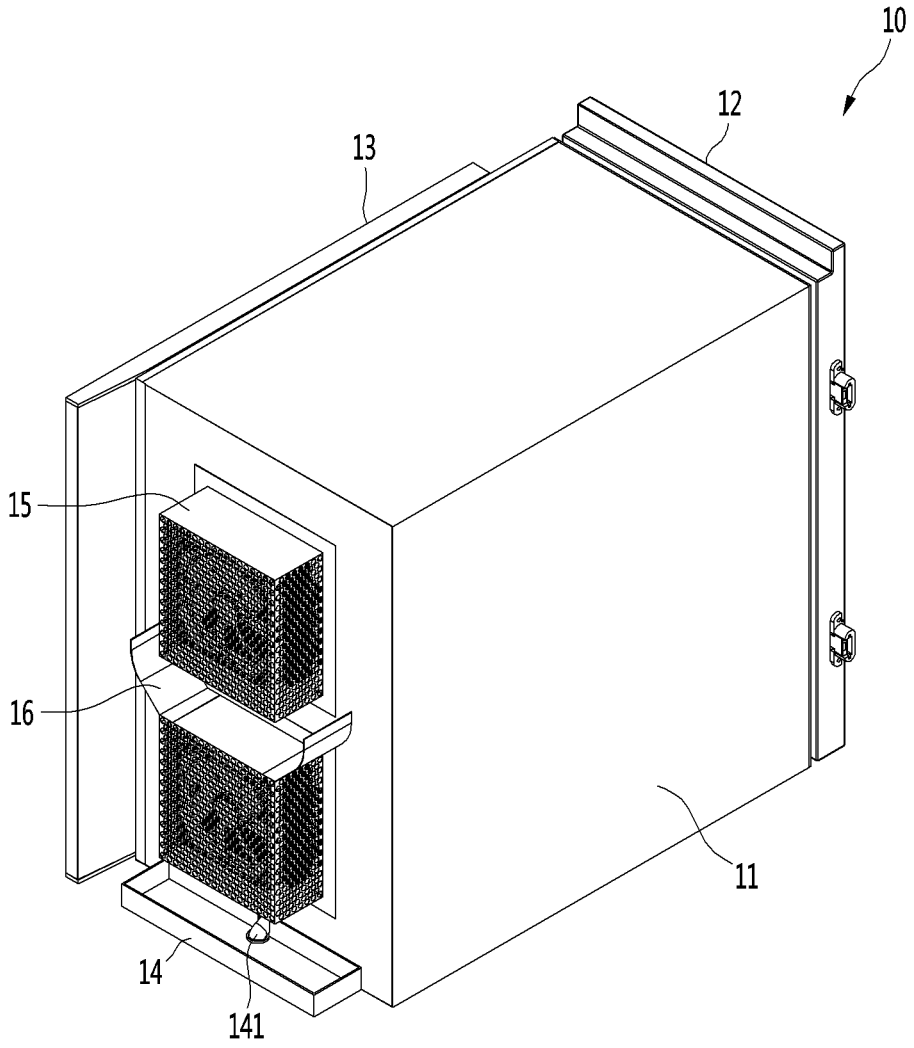
FIG. 4 is a rear perspective view of the entrance refrigerator.
Figure 5:
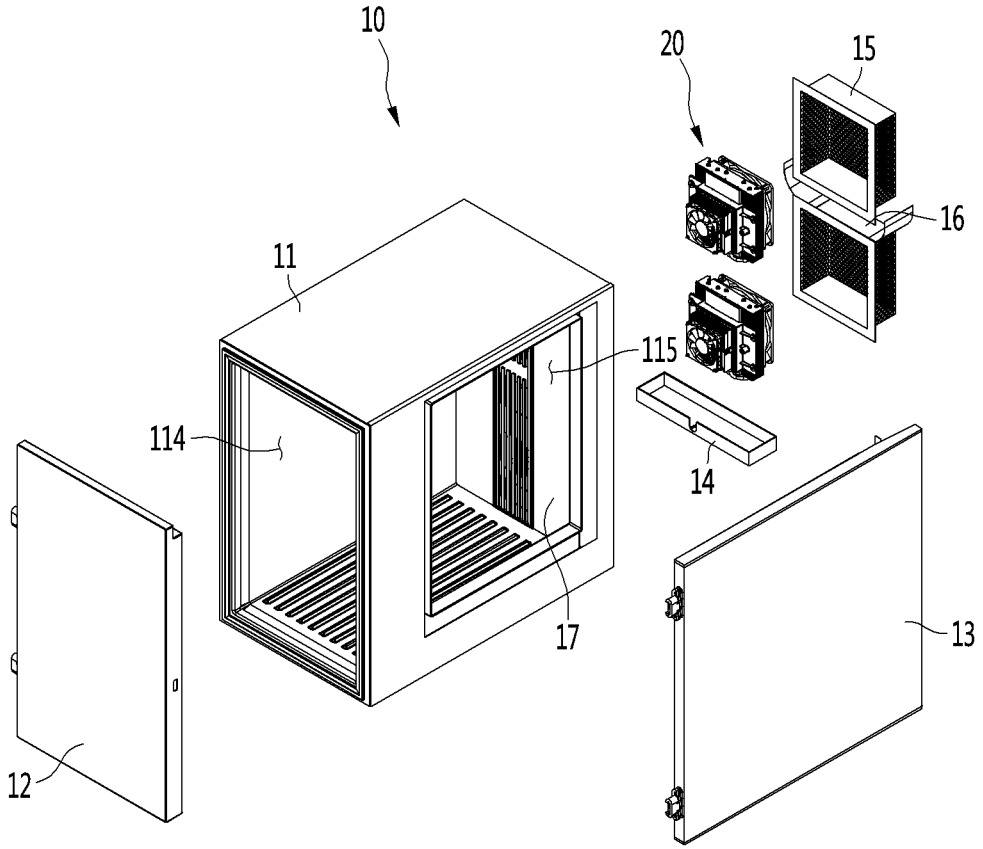
FIG. 5 is an exploded perspective view of the entrance refrigerator.
Figure 6:
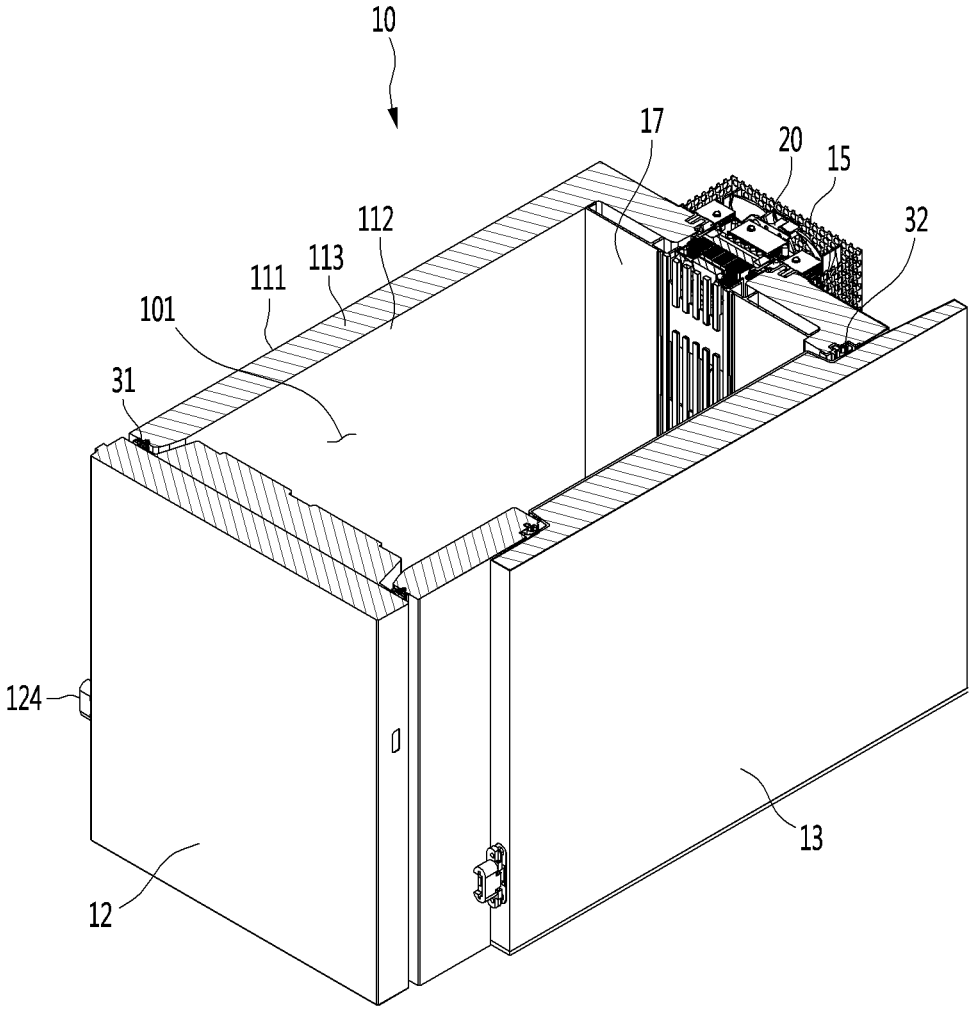
FIG. 6 is a cross-sectional cutaway perspective view of the entrance refrigerator taken along line 6-6 of FIG. 3.
Figure 7:
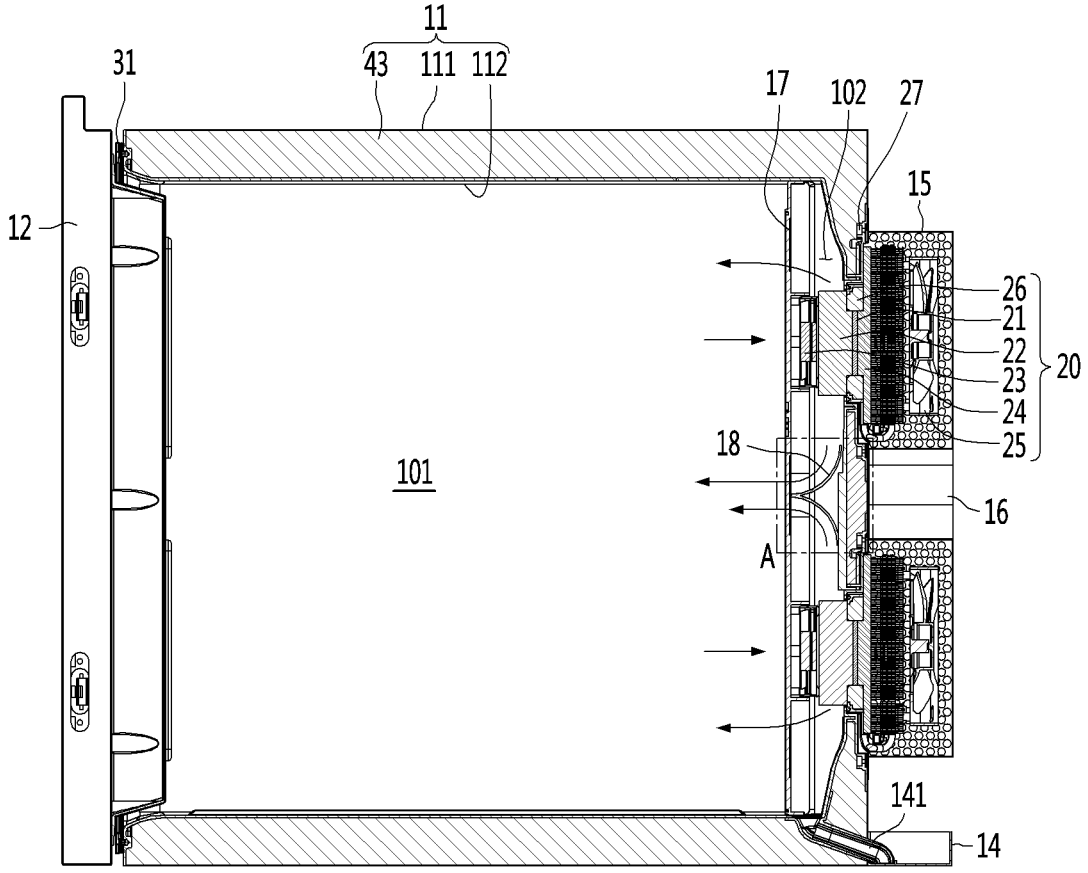
FIG. 7 is a side cross-sectional view of the entrance refrigerator taken along line 7-7 of FIG. 3.
Figure 8:
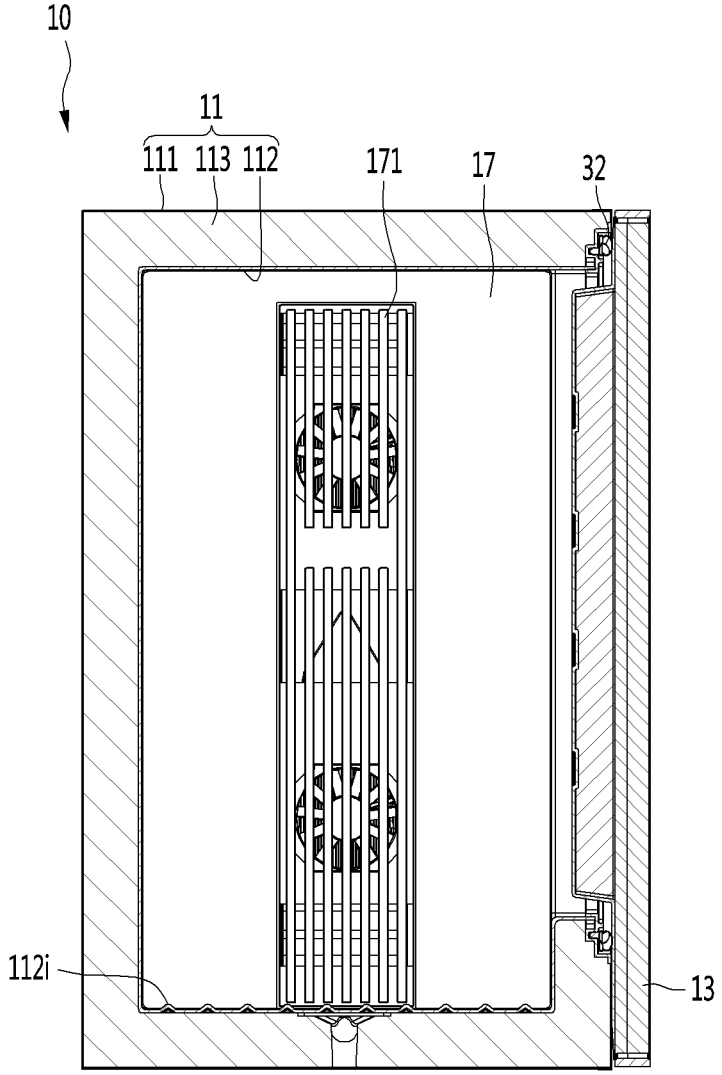
FIG. 8 is a longitudinal cross-sectional view of the entrance refrigerator taken along line 8-8 of FIG. 3.

FIG. 3 is a front perspective view of an entrance refrigerator according to an embodiment of the present disclosure, FIG. 4 is a rear perspective view of the entrance refrigerator, FIG. 5 is an exploded perspective view of the entrance refrigerator, FIG. 6 is a cross-sectional cutaway perspective view of the entrance refrigerator taken along line 6-6 of FIG. 3, FIG. 7 is a side cross-sectional view of the entrance refrigerator taken along line 7-7 of FIG. 3, and FIG. 8 is a longitudinal cross-sectional view of the entrance refrigerator taken along line 8-8 of FIG. 3.

Referring to FIGS. 3 to 8, the entrance refrigerator 10 according to an embodiment of the present disclosure may be a wall-embedded refrigerator in which a front portion passes through an outer wall 1.

Specifically, the entrance refrigerator 10 may include a cabinet 11 partially embedded in an outer wall 1 (e.g., an entrance/front wall of a dwelling/building), an outer door 12 for opening and closing an outer opening 114 provided at a front end of the cabinet 11, an inner door 13 for opening and closing an inner opening 115 provided on a side surface of the cabinet 11, and one or a plurality of cold air supply modules (e.g., assemblies) 20 mounted on a rear surface of the cabinet 11.

Here, the outer opening 114 may be provided on a front surface of the cabinet 11 and may be defined as a front opening, and the inner opening 115 may be provided on the side surface of the cabinet 11, adjacent to the outer opening 114, and may be defined as a side opening.

Alternatively, one of the outer opening 114 and the inner opening 115 may be defined as a first opening and the other may be defined as a second opening. One of the outer door 12 and the inner door 13 may be defined as a first door and the other may be defined as a second door.

In addition, a range in which the entrance refrigerator 10 is mounted on the outer wall 1 partitioning the indoor area and outdoor area may include the entrance refrigerator 10 being attached (e.g., embedded, connected) to a wall that partitions multiple indoor spaces, including a first indoor space and a second indoor space, or a wall that partitions an indoor area and an outer corridor.

For example, the entrance refrigerator 10 may be attached/embedded in a wall formed between an entrance door and a middle door that separates the entrance and a room of a home, such as a kitchen. In this case, when an article is input in the entrance, the article may be taken out in the kitchen on the other side.

Therefore, one of a space where the outer door 12 is exposed and a space where the inner door 13 is exposed may be defined as a first space, and the other may be defined as a second space. One of the first space and the second space may include one of an indoor space or an outdoor space, and the other of the first space and the second space may include an indoor space.

In another aspect, the space to which the door that is opened to store the delivery service article is exposed may be one of the indoor space and the outdoor space, and the space to which the door that is opened to take out the delivered article is exposed may be the indoor space.

In addition, the entrance refrigerator 10 may further include a heat dissipation cover 15 covering a rear surface of the cold air supply module 20 and an external air guide 16 guiding a flow of heat dissipation air discharged through the heat dissipation cover 15.

In this embodiment, a pair of cold air supply modules 20 are arranged up and down, and a pair of heat dissipation covers 15 cover the cold air supply modules 20, respectively. In addition, the external air guide 16 may be disposed between the pair of heat dissipation covers 15 disposed up and down and may function to guide the flow of heat dissipation air discharged from the lower heat dissipation cover 15.

The pair of cold air supply modules 20 may be defined as an upper first cold air supply module and a lower second cold air supply module.

Here, a structure in which a single cold air supply module 20 is disposed at the center of a rear surface of the cabinet 11 also falls within the scope of the present disclosure, in which the external air guide 16 may not be necessary.

The heat dissipation cover 15 may have a hexahedral shape, a front surface thereof may be open, and a flange may be bent extending from the open front surface and may be fixed to a rear surface of the cabinet 11.

A plurality of air vents may be formed only on rear, left, and right surfaces excluding the upper and lower surfaces of the heat dissipation cover 15. By this structure, indoor air may flow into the heat dissipation cover 15 through the air vent formed on the rear surface of the heat dissipation cover 15, and after heat exchange, the air may be discharged to the outside of the heat dissipation cover 15 through the air vents formed on the left surface and the right surface of the heat dissipation cover 15.

In addition, the entrance refrigerator 10 may further include a guide plate 17 disposed on a rear side in the cabinet 11. The guide plate 17 may be a partition member partitioning the inner space (e.g., interior space) of the cabinet 11 into a cold air generating compartment 102 (see FIG. 7) in which the cold air supply module 20 is accommodated and a storage compartment 101 in which a delivery service article is stored.

In addition, the entrance refrigerator 10 may further include a drain pan 14 and a drain hose 141 mounted at a lower end of the rear surface of the cabinet 11. The drain hose 141 extends from the bottom of the cold air generating compartment 102 to the drain pan 14 through the lower end of the rear surface of the cabinet 11. Therefore, condensate water collected at the bottom of the cold air generating compartment 102 is transported to the drain pan 14 through the drain hose 141 (e.g., the condensate water is collected by the drain pan 14).

Additionally, at least the front surface of the outer door 12 is exposed to the outdoor area and a courier that is authenticated may open the outer door 12. A front surface of the outer door 12 may be coplanar with or slightly protrude from, the front surfaces of the first storage 5 and second storage 6. Alternatively, the front surface of the outer door 12 may be designed to be coplanar with or slightly protrude from the outer wall 1.

The outer door 12 may be provided without a separate handle structure, in order to prevent easy access by a person, including a person who is not allowed access. When the outer door 12 is provided without a handle structure, if a delivery service article is recognized and authenticated by an authentication unit mounted on one side of the outer door 12 or on the control panel 4, the controller installed in the control panel 4 or the entrance refrigerator 10 may release a locked state of the outer door 12 and the controller operates a separate driving unit for pushing the outer door 12 so that the outer door 12 rotates forward by a predetermined angle, so that the courier may easily open the outer door.

In addition, when the article storage is completed (e.g., the article is stored in the cabinet 11) and the courier/person closes the outer door 12, the controller may return the outer door to a locked state.

In addition, in FIG. 3, a distance M from a front end of the cabinet 11 to a left surface of the inner door 13 may correspond to a thickness of the outer wall 1. A hinge of the inner door 13 may be installed at the cabinet 11 or may be installed in a portion other than the cabinet 11 including the outer wall 1. The hinge of the inner door 13 may allow the inner door 13 to rotate about the hinge between an open position and a closed position.

Further, a hinge 124 of the inner door 12 may also be installed at the cabinet 11 or may be installed at a portion other than the cabinet 11 including the outer wall 1. The hinge of the inner door 12 may allow the inner door 12 to rotate about the hinge between an open position and a closed position.

In addition, the cabinet 11 includes an outer case 111 forming an appearance, an inner case 112 positioned inside the outer case 111 to define the storage compartment 101, and a heat insulating material 113 filling a space between the outer case 111 and the inner case 112.

A plurality of protrusions **112*i* (see FIG. 8) may protrude from a bottom of the inner case 112. The plurality of protrusions 112*i* may extend from a front end to a rear end of the inner case 112 and protrude upward from the bottom of the inner case 112**.

In addition, the plurality of protrusions **112*i* may be arranged to be spaced apart from each other at a predetermined interval in a widthwise direction of the inner case 112**.

Since the plurality of protrusions **112*i* are formed at the bottom of the inner case 112, when a delivery service article that is heavy is pushed into and received in the storage compartment 101, the delivery service article may come into contact with the plurality of protrusions 112*i* formed on bottom of the inner case 112, thereby minimizing a frictional force as compared to contacting the entirety of the bottom of the inner case 12. Further, each of the plurality of protrusions 112*i* may be formed as a line protruding upwards from the bottom of the inner case 12, starting substantially from the outer opening 114 to an opposite side of the inner case 12**.

The plurality of protrusions **112*i*** may have a circular (e.g., dot) or hemispherical shape and may be arranged at a predetermined interval so as to come into point contact with a bottom surface of a delivery service article, thereby reducing a frictional force.

In addition, an outer gasket 31 is mounted on a front surface of the cabinet 11 corresponding to the edge of the outer opening 114, and an inner gasket 32 is mounted on a side surface of the cabinet 11 corresponding to the edge of the inner opening 115. The outer gasket 31 and the inner gasket 32 may be made of a material known in the art (i.e., the field of refrigeration and heating).

In addition, an inner air guide 18 is mounted on a rear surface of the guide plate 17 to guide cold air supplied from the cold air supply module 20 to the storage compartment 101.

Additionally, the cold air supply module 20 includes a cold air supply unit to which a thermoelectric element is applied. When a current is supplied (e.g., applied), one surface (e.g., a first surface) of the thermoelectric element acts as an endothermic surface absorbing heat as a temperature is decreased, and the other surface (e.g., a second surface opposite to the first surface) thereof acts as an exothermic surface dissipating heat as a temperature is increased.

The cold air supply module 20 may include a thermoelectric element 21, a cold sink 22 attached to the endothermic surface of the thermoelectric element 21, a heat sink 24 attached to the exothermic surface of the thermoelectric element 21, a heat absorption fan 23 placed (e.g., positioned) in front of the cold sink 22, a heat dissipation fan 25 placed (e.g., positioned) behind the heat sink 24, and an insulation block 26 surrounding the edges of the thermoelectric element 21.

Specifically, as shown in FIG. 7, the cold air supply module 20, may be mounted in a mounting hole formed on the rear surface of the cabinet 11. In a case where the pair of cold air supply modules 20 are disposed to be spaced apart in an up and down (e.g., vertical) direction, a first cold air supply module may be disposed at a lower portion of the rear surface of the cabinet 11 and a second cold air supply module may be mounted at a position/point on the rear surface of the cabinet corresponding spaced apart upward from the first cold air supply module.

The inner air guide 18 may be located between a heat absorption fan of the first cold air supply module and a heat absorption fan of the second cold air supply module. Due to the inner air guide 18, cold air flowing by the heat absorption fan of the first cold air supply module and cold air flowing by the heat absorption fan of the second cold air supply module may not be mixed and supplied to the storage compartment.

At least one or both of the heat absorption fan 23 and the heat dissipation fan 25 may be an axial flow fan or a centrifugal fan.

Each cold sink 22 includes a sink body and a plurality of heat exchange fins arranged on a front surface of the sink body. A rear surface of the sink body is in close contact with the front surface of the thermoelectric element 21, the heat exchange fins may be perpendicular to the front surface of the sink body. The plurality of heat exchange fins are spaced apart from each other in a widthwise direction of the sink body. Therefore, cold air inside the storage compartment 101 pulled in by the heat absorption fan 23 hits the front surface of the sink body and flows in an up-down direction through flow paths formed between the plurality of heat exchange fins in a distributed manner. The cold air cooled while exchanging heat with the cold sink 22 passes through a discharge grille 171 (see FIG. 8) formed at the guide plate 17 along the inner air guide 18 and then is supplied to the storage compartment 101.

Like the cold sink 22, the heat sink 24 may include a sink body whose rear surface is attached to the exothermic surface of the thermoelectric element 21 and a plurality of heat exchange fins extending from a front surface of the sink body.

Since the heat sink 24 must have a larger heat exchange amount than the cold sink 22, the heat sink 24 may have a larger volume than the cold sink 22, and a heat transfer unit such as a heat pipe may be additionally installed therein. This is due to physical properties that a cooling capacity of the thermoelectric element decreases as a temperature difference between the endothermic surface and the exothermic surface increases. Therefore, in order to maximize the cooling capacity of the thermoelectric element 21, a heat dissipation capacity of the heat sink 24 is set larger than that of the cold sink 22.

In addition, since the heat exchange fins of the heat sink 24 extend in a horizontal direction and are spaced apart from each other in a vertical direction, ambient air (e.g., indoor air) pulled in by the heat dissipation fan 25 hits (e.g., contacts) the surface of the sink body of the heat sink 24 and then dividedly flow in a left-right direction.

In particular, the heat dissipation air dividedly flowing to the left and right after hitting the heat sink 24 at the lower side so as to be heat-exchanged hits a bottom surface of the external air guide 16 and is guided to flow dividedly to the left and right of the heat dissipation cover 15.

Additionally, condensate water formed on a surface of the cold sink 22 flows to the bottom of the cold air generating compartment 102 and is collected to a drain pan 14 through a drain hose 141. The drain hose 141 extends to the drain pan 14 from the bottom of the inner case 112, which defines the bottom of the cold air generating compartment 102, through the cabinet 11.

Figure 9:
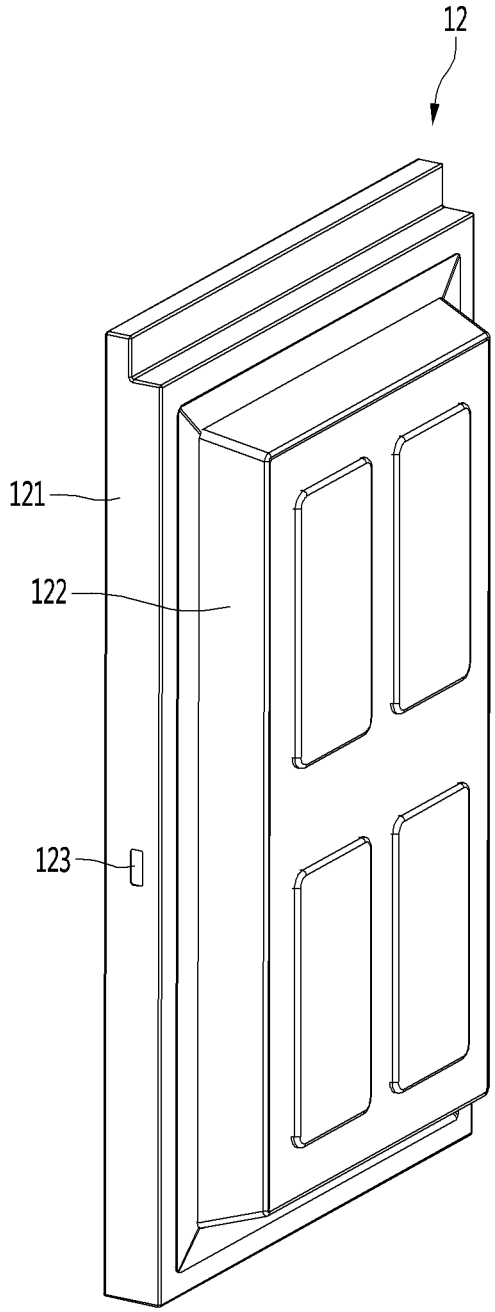
FIG. 9 is a rear perspective view of an outer door of an entrance refrigerator according to an embodiment of the present disclosure.

FIG. 9 is a rear perspective view of an outer door of an entrance refrigerator according to an embodiment of the present disclosure.

Referring to FIG. 9, the outer door 12 of the entrance refrigerator 10 according to an embodiment of the present disclosure may include a door body 121 and a door liner 122 protruding from a rear surface of the door body 121. The door liner 122 may encompass an entire rear surface of the door body 121 or may encompass less than an entire rear surface of the door body 121, such as shown in FIG. 9.

The door body 121 may be formed of a metal having a fireproofing function that may tolerate a flame when a fire breaks out in the outdoor corridor. The door body 121 may be filled with a fire resistant block.

In addition, the door liner 122 is a portion led into (e.g., extends into) the storage compartment 101 through the outer opening 114 when the outer door 12 is closed. Therefore, the door liner 122 may be filled with insulation foam so that cold air of the storage compartment 101 is not leaked to the outside by heat conduction.

When the outer door 12 is closed, the outer gasket 31 (see FIG. 7) surrounding the edges of the outer opening 114 is in close contact with the rear surface of the door body 121. Specifically, the outer gasket 31 is in close contact with the edges of the door liner 122, thereby blocking leakage air from within the entrance refrigerator 10, including hot air or cold air.

In addition, the hinge 124 is mounted on one surface of the door body 121 (or one surface of the outer door), and a latch recess 123 may be provided on the other surface of the door body 121 (or the other surface of the outer door). A door latch is inserted into the latch recess 123 to maintain the outer door 12 in a locked state, and the door latch may be provided in a partition 7 partitioning the entrance refrigerator 10 and the entrance door 3.

Specifically, the door latch may be mounted in a horizontal direction on a side surface of the partition 7 facing the other side surface of the door body 121 and may be drawn out from the partition 7 or drawn into the partition 7.

Conversely, the door latch may be installed to be drawn in or out from the door body 121 and the latch recess may be provided on a side surface of the partition 7.

Figure 10:
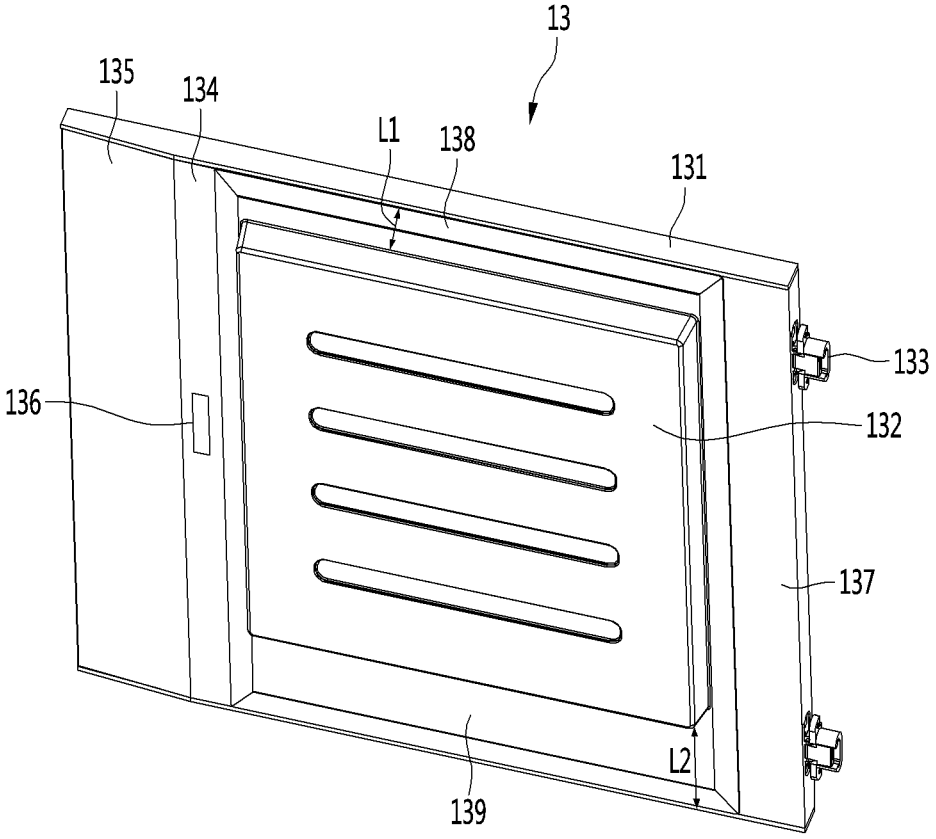
FIG. 10 is a rear perspective view of an inner door of an entrance refrigerator according to an embodiment of the present disclosure.

FIG. 10 is a rear perspective view of an inner door of the entrance refrigerator according to an embodiment of the present disclosure.

Referring to FIG. 10, the inner door 13 of the entrance refrigerator 10 according to an embodiment of the present disclosure may include a door body 131 and a door liner 132 provided on a rear surface of the door body 131.

Specifically, the door body 131 and the door liner 132 may be formed of a plastic material and may be filled with a heat insulating material therein. However, the door body 131 may be formed of a metal depending on design conditions.

The door liner 132 protrudes from the rear surface of the door body 131 by a predetermined thickness, and when the inner door 13 is closed, the door liner 132 is led into (e.g., positioned in) the storage compartment 101 through the inner opening 115.

In addition, when the inner door 13 is closed, the inner gasket 32 surrounding the edges of the inner opening 115 is in close contact with the rear surface of the door body 131 corresponding to the edges of the door liner 132.

A hinge 133 is mounted on one side (e.g., a first side) of the door body 131, and the hinge 133 may be fixed to the outer wall 2 or may be fixed to the cabinet 11. Since a front end of the cabinet 11 is embedded in the outer wall 2, the one side (e.g., first side) of the inner door 13, that is, the side on which the hinge 133 is mounted, may be spaced apart from the front end of the cabinet 11 by a predetermined distance (M: see FIG. 3).

In addition, the other side (e.g., second side) of the inner door 13 corresponding to the opposite side of the side on which the hinge 133 is mounted may be located at a rear side with respect to the rear end of the cabinet 11. That is, the side end portion defining the other side of the inner door 13 may extend further to a rear than a rear end of the cabinet 11 so as to be adjacent to the third storage 8. According to this structure, the components provided on the rear surface of the cabinet 11 including the heat dissipation cover 15, the drain pan 14, and the external air guide 16 are not exposed to the outside.

Specifically, a rear surface portion of the door body 131 may include a left rear surface portion from one side of the door body 131 to one side of the door liner 132, a right rear surface portion from the other side of the door body 131 to the other side of the door liner 132, an upper rear surface portion 138 from an upper end of the door body 131 to an upper end of the door liner 132, and a lower rear surface portion 139 from a lower end of the door body 131 to a lower end of the door liner 132.

In addition, the right rear surface portion may include a first right rear surface portion 134 in close contact with the side of the cabinet 11 when the inner door 13 is closed, and a second right rear surface portion 135 from the edge of the first right rear surface portion 134 to the other side of the door body 131.

A latch recess 136 may be formed at the first right rear surface portion 134, and a door latch may be provided in the cabinet 11 corresponding to the latch recess 136. That is, a locking device for locking the inner door 13 may be provided on the first right rear surface portion 134 and the cabinet 11 corresponding thereto.

The second right rear surface portion 135 is a portion extending further from the rear end of the cabinet 11 to the rear side, which serves to shield a space between the rear surface of the cabinet 11 and the third storage 8. That is, the second right rear surface portion 135 may extend from the first right rear surface portion 134.

In addition, a vertical width L1 of the second right rear surface portion 135 may be formed smaller than a vertical width L2 of the lower rear surface portion 139 (see FIG. 10). This is because, as shown in FIG. 8, the length from the lower end of the side of the cabinet 11 to the lower end of the inner opening 115 is greater than a thickness of the cabinet 11.

The lower end of the inner opening 115 is formed higher than the bottom of the storage compartment 101, so that when the inner door 13 is opened, a phenomenon that cold air that stays on the bottom of the storage compartment 101 is leaked to the outside through the inner opening 115 may be minimized, thereby minimizing air leakage (e.g., loss of cold air).

In order to minimize the air leakage phenomenon (e.g., cold air leakage), the lower end of the inner opening 115 may also be designed higher than the bottom of the storage compartment 101.

Figure 11:
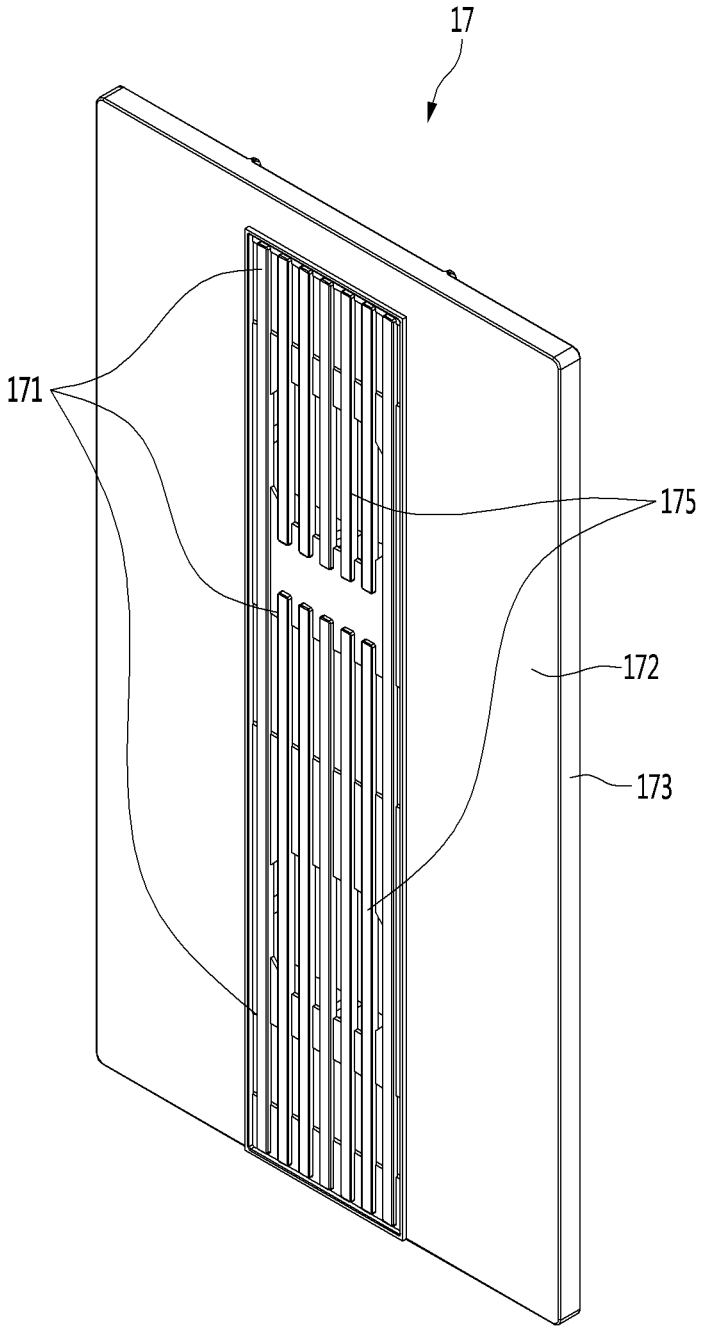
FIG. 11 is a front perspective view of a guide plate of an entrance refrigerator according to an embodiment of the present disclosure.
Figure 12:
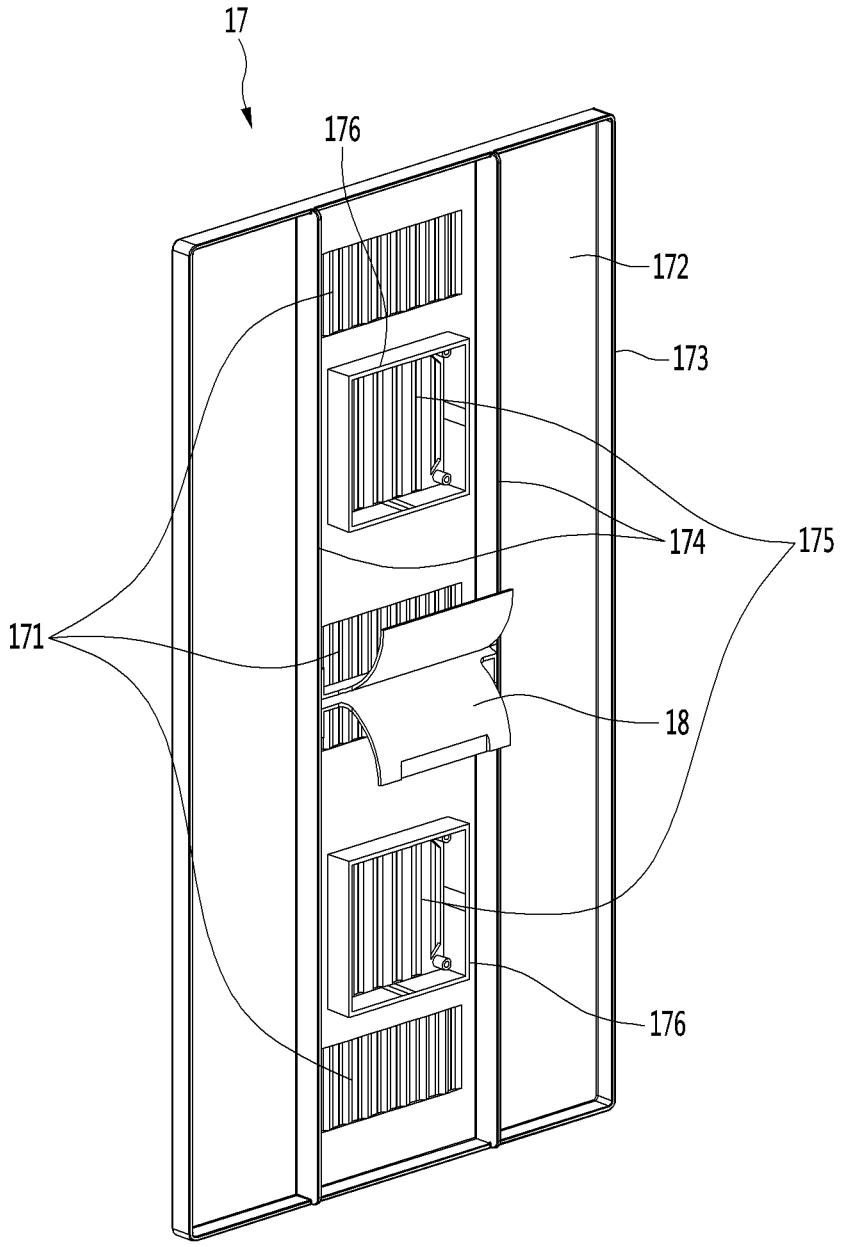
FIG. 12 is a rear perspective view of the guide plate.

FIG. 11 is a front perspective view of a guide plate of an entrance refrigerator according to an embodiment of the present disclosure, and FIG. 12 is a rear perspective view of the guide plate.

Referring to FIGS. 11 and 12, the guide plate 17 according to an embodiment of the present disclosure may include a plate body 172 having a rectangular shape, a bent portion 173 bent backward (e.g., extending backward or rearward) along the edges of the plate body 172, and at least a pair of reinforcing ribs 174 protruding from a rear surface of the plate body 172 and extending from an upper end of the plate body 172 to a lower end thereof. The bent portion 173 is in close contact with an inner surface of the inner case 112.

Further, a distance from a left edge of the plate body 172 to one of the pair of reinforcing ribs 174 may be equal to a distance from a right edge of the plate body 172 to the other of the pair of reinforcing ribs 174.

In addition, a plurality of grilles may be arranged to be spaced apart from each other in an up-down direction, i.e., in a lengthwise direction of the plate body 171, on the plate body 172 corresponding to between the pair of reinforcing ribs 174.

The grilles may be a structure including an opening formed at the plate body 172 and a plurality of vertical ribs formed in the opening. The plurality of vertical ribs may be spaced apart from each other in a widthwise direction of the opening that defines the grilles.

The plurality of grilles may include a plurality of discharge grilles 171 formed at a central portion of the plate body 172, an upper edge portion of the plate body 172, and a lower edge portion of the plate body 172, and a plurality of intake grilles 175 formed between the vertically adjacent discharge grilles 171.

The plurality of discharge grilles 171 may include an upper discharge grille formed near the upper edge of the plate body 172, a central discharge grille formed at the center of the plate body 172, and a lower discharge grille formed near the lower edge of the plate body 172.

In addition, a vertical length of the opening defining the central discharge grille may be designed to be twice a vertical length of the opening that defines the upper discharge grille, and a vertical length of the opening that defines the upper discharge grille may be designed to be equal to a vertical length of the opening that defines the lower discharge grille.

The plurality of intake grilles 175 may include an upper intake grille formed between the upper discharge grille and the central discharge grille and a lower intake grille formed between the central discharge grille and the lower discharge grille. The upper intake grille and the lower intake grille may be designed to have the same size or may have different sizes.

The heat absorption fan 23 of the cold air supply module 20 may be disposed on the rear side of the plurality of intake grilles 175.

A support rib 176 extends along the edge of the opening that defines the intake grille 175 to form a rectangular fan accommodating portion. Further, the support rib 176 may extend along an entire periphery of the edge of the opening that defines the intake grille 175 to form the rectangular fan accommodating portion. In addition, a portion of a front surface of the heat absorption fan 23 is accommodated in the fan accommodating portion defined by the support rib 176.

In addition, the inner air guide 18 may be mounted on a rear surface of the plate body 172 corresponding to (e.g., at, positioned on) the center of the central discharge grille. When the heat absorption fan 23 is driven, cold air of the storage compartment 101 is introduced into the cold air generating compartment 102 through the upper intake grille and the lower intake grille to hit (e.g., contact) the surface of the cold sink 22.

The cold air that hits the cold sink 22 is lowered in temperature through heat exchange and then dividedly flow in an up-down direction of the cold sink 22. A part of the cold air flowing in the up-down direction of the cold sink 22 flows back into the storage compartment 101 through the upper discharge grille and the lower discharge grille.

Additionally, cold air flowing along the inner air guide 18 is introduced back into the storage compartment 101 through the central discharge grille.

Here, intake and discharge flow paths of the cold air may be reversed according to types of the heat absorption fan 23, in which case the intake grilles may function as discharge grilles and the discharge grilles may function as intake grilles.

Figure 13:
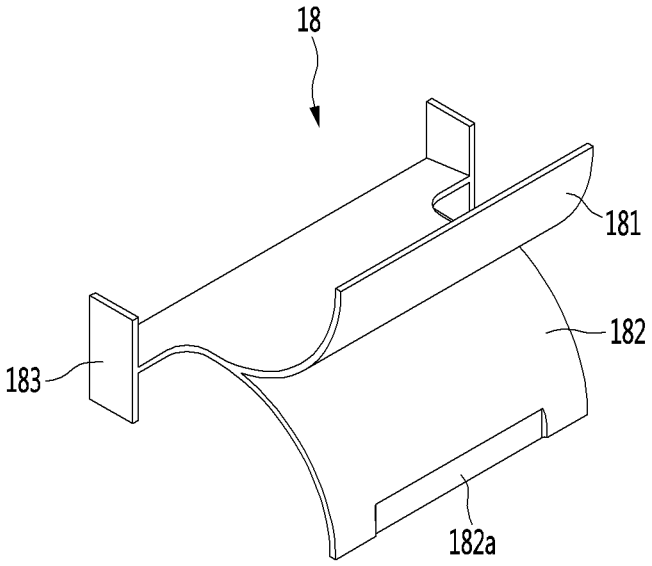
FIG. 13 is a rear perspective view of an inner air guide of an entrance refrigerator according to an embodiment of the present disclosure.

FIG. 13 is a rear perspective view of the inner air guide of an entrance refrigerator according to an embodiment of the present disclosure.

Referring to FIG. 13, the inner air guide 18 according to an embodiment of the present disclosure may include an upper guide 181 extending to be rounded upward (e.g., curved upwards) from a front end toward a rear end, a lower guide 182 extending to be rounded downward (e.g., curved downwards) from the front end toward the rear end thereof, and a flange 183 extending vertically from the side of the front end where the upper guide 181 and the lower guide 182 meet. The front end (e.g., base) where the upper guide 181 and the lower guide 182 meet may be substantially planar and may extend in a horizontal direction. Further, the upper guide 181 and the lower guide 182 may be symmetric about the front end where the upper guide 181 and the lower guide 182 meet.

The front end of the upper guide 181 may meet the front end of the lower guide 182 to form a single body. That is, the inner air guide 18 may be formed of a singular unitary body having an upper guide 181 and a lower guide 182, the upper guide 181 and the lower guide 182 meet at a single point, and the upper guide 181 and the lower guide 182 may be curved in opposite directions from the single point.

The upper guide 181 and the lower guide 182 may be rounded or inclined in a vertically symmetrical shape with respect to a horizontal surface where front ends of the upper guide 181 and the lower guide 182 meet, i.e., a horizontal surface that vertically bisects the inner air guide 18.

Specifically, the upper guide 181 may be rounded in a direction in which a slope of a tangent passing through a rear surface of the upper guide 181 increases from the front end toward the rear end.

Alternatively, the upper guide 181 and the lower guide 182 may be inclined at the same angle to an upper side and a lower side from the horizontal plane, the upper guide 181 and the lower guide 182 meeting (e.g., adjoining) at the horizontal plane, and the horizontal plane bisects the inner air guide 18 vertically (e.g., in an up and down direction).

Here, the rear surface of the upper guide 181 and the rear surface of the lower guide 182 may refer to two surfaces facing each other (or extending away from each other, as shown in FIG. 13), and the opposite surfaces of the rear surfaces may be defined as a front surface of the upper guide 181 and a front surface of the lower guide 182, respectively.

The flange 183 extends from the left and right ends of the upper guide 181 and the lower guide 182 and is coupled to the pair of reinforcing ribs 174 formed on the rear surface of the guide plate 17.

Specifically, the front end of the inner air guide 18 may be disposed at a point that bisects the central discharge grille of the guide plate 17 up and down. Accordingly, cold air forcedly flowing by the upper heat absorption fan 23 and cold air forcedly flowing by the lower heat absorption fan 23 are discharged to the storage compartment 101 substantially uniformly through the central discharge grille.

In addition, the flange 183 may be fixedly mounted to the reinforcing rib 174 by a screw or other fastener passing through the reinforcing rib 174. Alternatively, the flange 183 may be attached to the reinforcing rib 174 by an adhesive member, brazing, welding or any other joining method.

Alternatively, the flange 183 may not be provided, and the front ends where the upper guide 181 and the lower guide 182 meet may be attached directly to the rear surface of the guide plate 17, such as by fastening with fasteners, adhesive bonding, brazing or welding.

In addition, a rear end of the upper surface of the lower guide 182 may be provided with an interference preventing recess 182*a*, and a function of the interference preventing recess 182*a* will be described in detail with reference to the drawings below. The interference preventing recess 182*a* is provided at a rear end of the lower guide 182, opposite to the front end where the upper guide 181 meets the front end of the lower guide 182. Further, the interference preventing recess 182*a* may extend substantially an entire width of the rear end of the lower guide 182, or may extend less than an entire width of the rear end of the lower guide 182.

Figure 14:
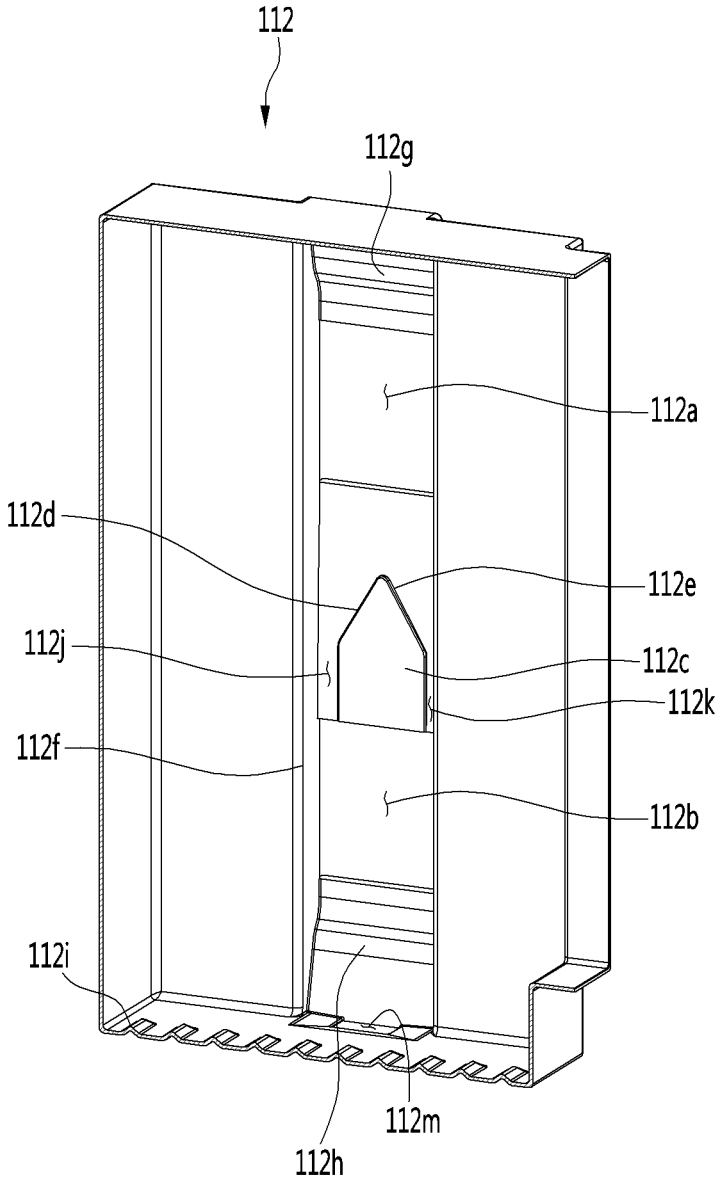
FIG. 14 is a cutaway perspective view showing a rear wall of an inner case of a cabinet of an entrance refrigerator according to an embodiment of the present disclosure.
Figure 15:
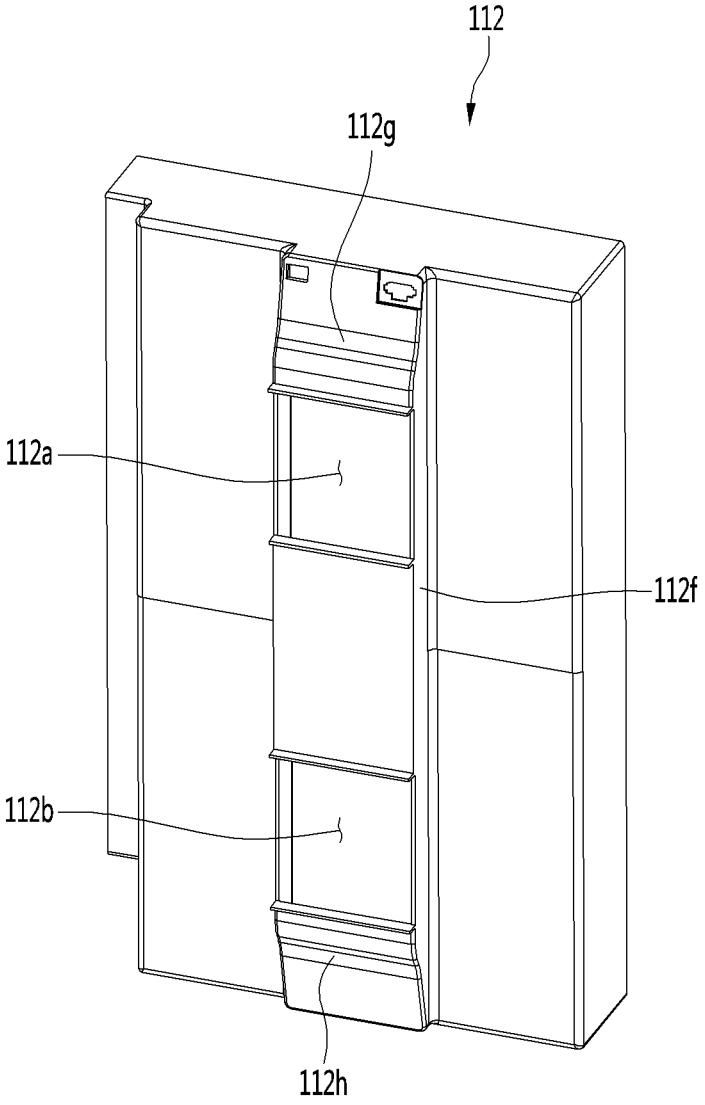
FIG. 15 is a rear perspective view of a rear wall of the inner case.

FIG. 14 is a cutaway perspective view showing a rear wall of an inner case of a cabinet of an entrance refrigerator according to an embodiment of the present disclosure, and FIG. 15 is a rear perspective view of the rear wall of the inner case.

Referring to FIGS. 14 and 15, a through-hole in which one or a plurality of cold air supply modules 20 are mounted is provided on a rear wall of the inner case 112 of the cabinet 11 of the entrance refrigerator 10 according to an embodiment of the present disclosure.

Specifically, in a case where a pair of cold air supply modules 20 are mounted on the rear wall/surface of the cabinet 11, an upper through-hole 112*a* and a lower through-hole 112*b* may be provided on the rear wall of the cabinet 11.

At the center of the rear wall of the inner case 112, a center recess 112*f* having a predetermined width may be provided to extend from an upper end of the rear wall of the inner case 112 to a lower end of the inner case 112 (e.g., the center recess 112*f* extend an entire distance from an upper end of the rear wall of the inner case 112 to a lower end of the inner case 112). The center recess 112*f* may be a portion of the rear wall of the inner case 112, which is recessed or stepped backward, and may be formed by a forming process, such as a deforming process (e.g., pressing, molding, etc.).

An upper end of the upper through-hole 112*a* is spaced apart by a predetermined distance downward (e.g., is spaced downward from) from an upper end of the center recess 112*f*, and a lower end of the lower through-hole 112*b* is spaced apart by a predetermined distance upward (e.g., is spaced upward from) from a lower end of the center recess 112*f*.

Further, on the rear wall of the inner case 112 defining the center recess 112*f*, an upper guide portion 112*g* rounded in a direction protruding rearward or stepped a plurality of times in a stairway (e.g., stair-like or stair) shape from the upper end of the center recess 112*f* toward the upper end of the upper through-hole 112*a* is defined.

In the same manner, a lower guide portion 112*h* is provided at a portion from the lower end of the center recess 112*f* to the lower end of the lower through-hole 112*b*.

The upper guide portion 112*g* and the lower guide portion 112*h* may be understood as portions provided to guide a flow of air pulled in by the intake fan 23 and ascends or descends along the cold sink 22 toward the discharge grille 171 of the guide plate 17.

Therefore, when the upper guide portion 112*g* and the lower guide portion 112*h* are designed to be smoothly rounded toward the front of the inner case 112, flow resistance that may occur in the process of guiding air cooled while passing through the cold sink 22 to the storage compartment 101 may be minimized.

Additionally, a guide protrusion 112*c* may be provided for guiding a flow of condensate water, and the guide protrusion

112*c* may protrude from the rear wall of the inner case 112 corresponding to between the upper through-hole 112*a* and the lower through-hole 112*b*.

Specifically, the guide protrusion 112*c* may be formed to have a width narrower toward the upper through-hole 112*a*. Specifically, the guide protrusion 112*c* includes a left inclined portion 112*d* and a right inclined portion 112*e*, and an upper end of the left inclined portion 112*d* and an upper end of the right inclined portion 112*e* meet to form a peak. That is, the guide protrusion 112*c* may form a triangular shape with the left inclined portion 112*d* and the right inclined portion 112*e*.

In addition, the left inclined portion 112*d* and the right inclined portion 112*e* may extend from a point where they are spaced apart upward from the lower through-hole 112*b*. In other words, the guide protrusion 112*c* may extend vertically upward with a predetermined width from the upper end of the lower through-hole 112*b* and extend to have a narrower width, starting from a point where the left inclined portion 112*d* and the right inclined portion 112*e* are formed (e.g., begin).

By this structure, condensate water or defrost water flowing down the surface of the cold sink 22 of the cold air supply module 20 mounted at the upper through-hole 112*a* flows down to the bottom of the inner case 112 along a left edge and a right edge of the guide protrusion 112*c*.

Specifically, the condensate water or the defrost water flows down to the bottom of the inner case 112 along a left flow path 112*j* formed at a left edge of the center recess 112*f* and a left edge of the guide protrusion 112*c* and a right flow path 112*k* formed at a right edge of the center recess 112*f* and a right edge of the guide protrusion 112*c*.

Here, the condensate water or the defrost water flowing down to the upper end of the guide protrusion 112*c* is divided at the left inclined portion 112*d* and the right inclined portion 112*e* to flow to the left flow path 112*j* and the right flow path 112*k*.

In addition, a drain hole 112*m* is formed at a point where the rear wall and the bottom surface of the inner case 112 meet, and one end of the drain hose 141 is connected to the drain hole 112*m*. Therefore, the condensate water or the defrost water flowing down to the bottom of the inner case 112 is collected to the drain pan 14 along the drain hose 141.

As another example, the left inclined portion 112*d* and the right inclined portion 112*e* may extend from the upper end of the lower through-hole 112*b*, so that the guide protrusion 112*c* may have a triangular protrusion shape.

Thus, by allowing the condensate water or the defrost water flowing from the upper cold sink 22 to flow along both side ends of the cold sink of the cold air supply module 20, a phenomenon that cold air forcedly flowing by the heat absorption fan 23 acts as flow resistance to the condensate water may be minimized.

Specifically, cold air introduced into the cold air generating compartment 102 from the storage compartment 101 by the heat absorption fan 23 (e.g., by being pulled by the heat absorption fan 23) directly hits (e.g., contacts) the front surface of the cold sink 22 and then dividedly flows to the upper side and the lower side. In addition, a flow rate of the cold air hitting the front surface of the cold sink 22 is relatively low from the center of the front surface of the cold sink 22 toward the both side ends.

Therefore, a flow resistance may occur as the cold air ascending after hitting the surface of the cold sink of the cold air supply module 20 mounted in the lower through-hole 112*b* pushes up the condensate water or the defrost water flowing down from the upper cold sink 22.

Here, the flow resistance acting on the condensate water or the defrost water that flows down may be minimized by dispersing the flow of the condensate water or the defrost water to the left flow path 112*j* and the right flow path 112*k*.

Figure 16:
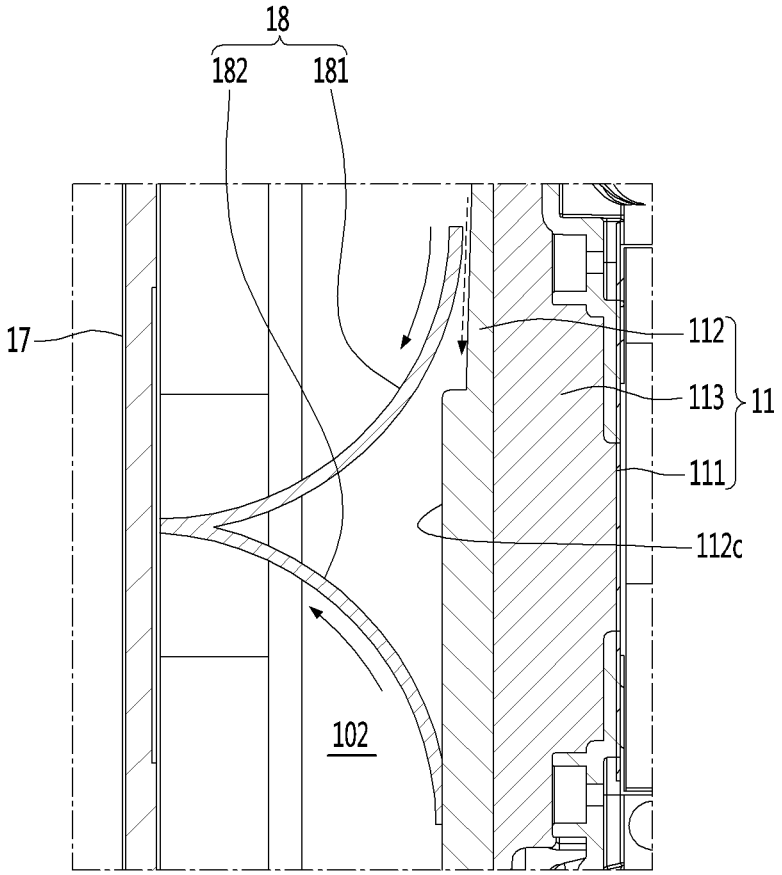
FIG. 16 is an enlarged cross-sectional view of a portion A of FIG. 7.

FIG. 16 is an enlarged cross-sectional view of part A of FIG. 7.

Referring to FIG. 16, as indicated by the solid arrows, when the heat absorption fan (upper heat absorption fan) of the first cold air supply module and the heat absorption fan (lower heat absorption fan) of the second cold air supply module are driven, cold air (e.g., intake air) of the storage compartment 101 is pulled into the cold air generating compartment 102 through the guide plate 17.

The cold air pulled into the cold air generating compartment 102 is changed in a flow direction by 180 degrees by the upper guide 181 and the lower guide 182. That is, the cold air pulled by the heat absorption fans hits the front surface of the sink body of the cold sink 22 and descends, and then is dispersed up and down.

The cold air dispersed up and down is changed in flow direction toward the storage compartment by the upper guide 181 and the lower guide 182. The cold air changed in flow direction is discharged to the storage compartment 101 through the guide plate 17.

Additionally, a rear end of the upper guide 181 of the inner air guide 18 is spaced apart from the rear wall of the inner case 112 defining the center recess 112*f*. This is to prevent the flow of the condensate water or the defrost water flowing down along the rear wall of the inner case 112 as indicated by the dotted arrow from being interfered by the upper guide 181.

If the rear end of the upper guide 181 is in contact with the rear wall of the inner case 112, the condensate water or the defrost water moves to the front end of the upper guide 181 along the upper surface of the upper guide 181. In addition, the condensate water or the defrost water flowing along the upper surface of the upper guide 181 flows down to the bottom of the storage compartment 101 along the guide plate 17. Then, the condensate water flowing down to the bottom of the inner case 112 does not flow toward the drain hole 112*m* formed at the bottom of the cold air generating compartment 102 but remains at the bottom of the storage compartment 101. This phenomenon may cause mold to occur inside the storage compartment 101 and to cause odor.

Additionally, the rear end of the lower guide 182 may be in contact with the guide protrusion 112*c*, and the interference preventing recess 182*a* formed on the upper surface of the rear end of the lower guide 182 may be defined as a recess accommodating the guide protrusion 112*c*. Therefore, a width of the interference preventing recess 182*a* may be formed to have a size corresponding to the width of the guide protrusion 112*c*.

Of course, the left edge and the right edge of the rear end of the lower guide 182 are spaced apart from the rear wall of the inner case 112 defining the left flow path 112*j* and the right flow path 112*k*.

Additionally, the front surface of the rear wall of the inner case 112 from the lower end of the upper through-hole 112*a* and the upper end of the lower through-hole 112*b* may be formed to be inclined in the form of protruding forward toward a lower side (e.g., inclined toward a lower side). The inclined structure may also be applied to the rear wall of the inner case 112 defining the left flow path 112*j* and the right flow path 112*k* in the same manner.

The inclined structure may minimize a phenomenon that the condensate water or the defrost water falling from the cold sink 22 of the first cold air supply module 20 hits directly the cold sink 22 of the second cold air supply module 20 and scatters.

That is, by allowing the condensate water or the defrost water to flow along the inclined rear wall of the inner case 112 to reach the surface of the cold sink 22 of the second cold air supply module 20, scattering of the condensate water may be minimized.

Hereinafter, a condensation removal device for removing condensation formed on surfaces of the outer gasket 31 and the inner gasket 32 or the outer surface of the cabinet corresponding to a vicinity of these gaskets and preventing a condensation phenomenon will be described in detail with reference to the accompanying drawings.

Figure 17:
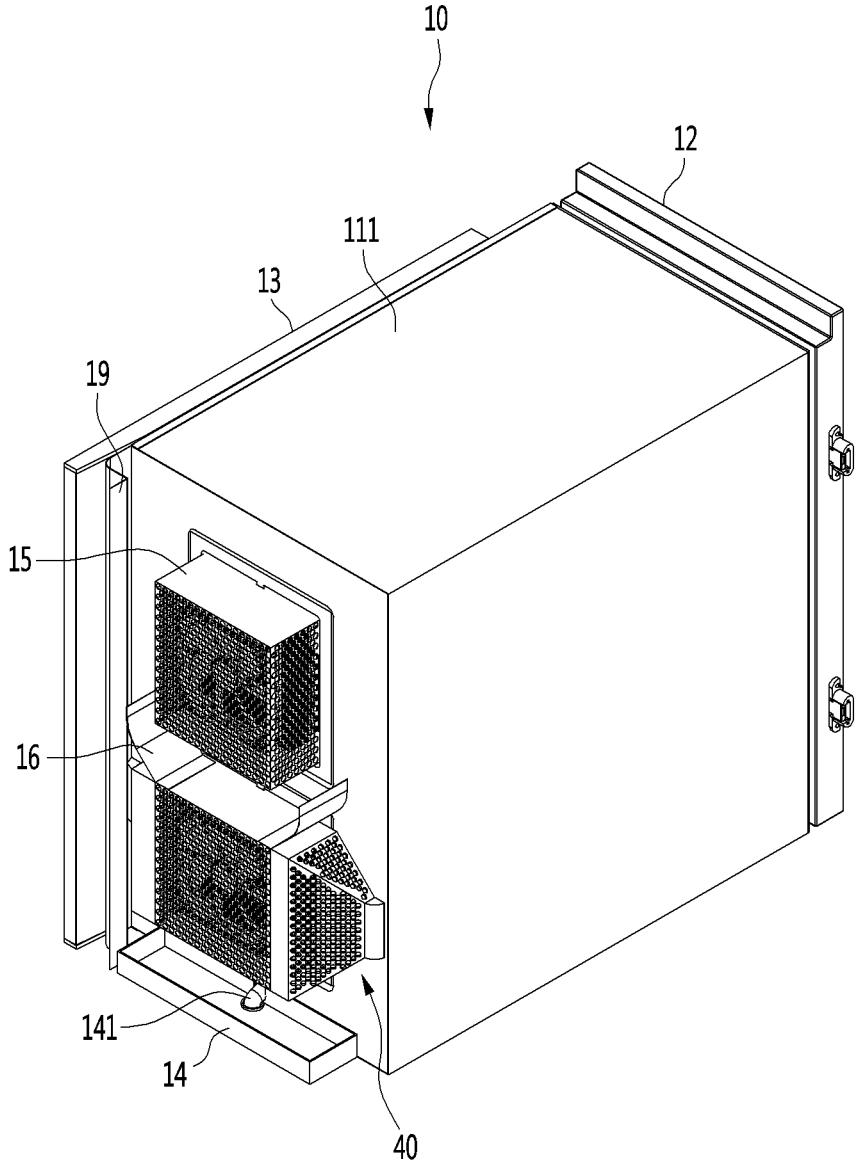
FIG. 17 is a rear perspective view of an entrance refrigerator equipped with a condensation removal device according to an embodiment of the present disclosure.
Figure 18:
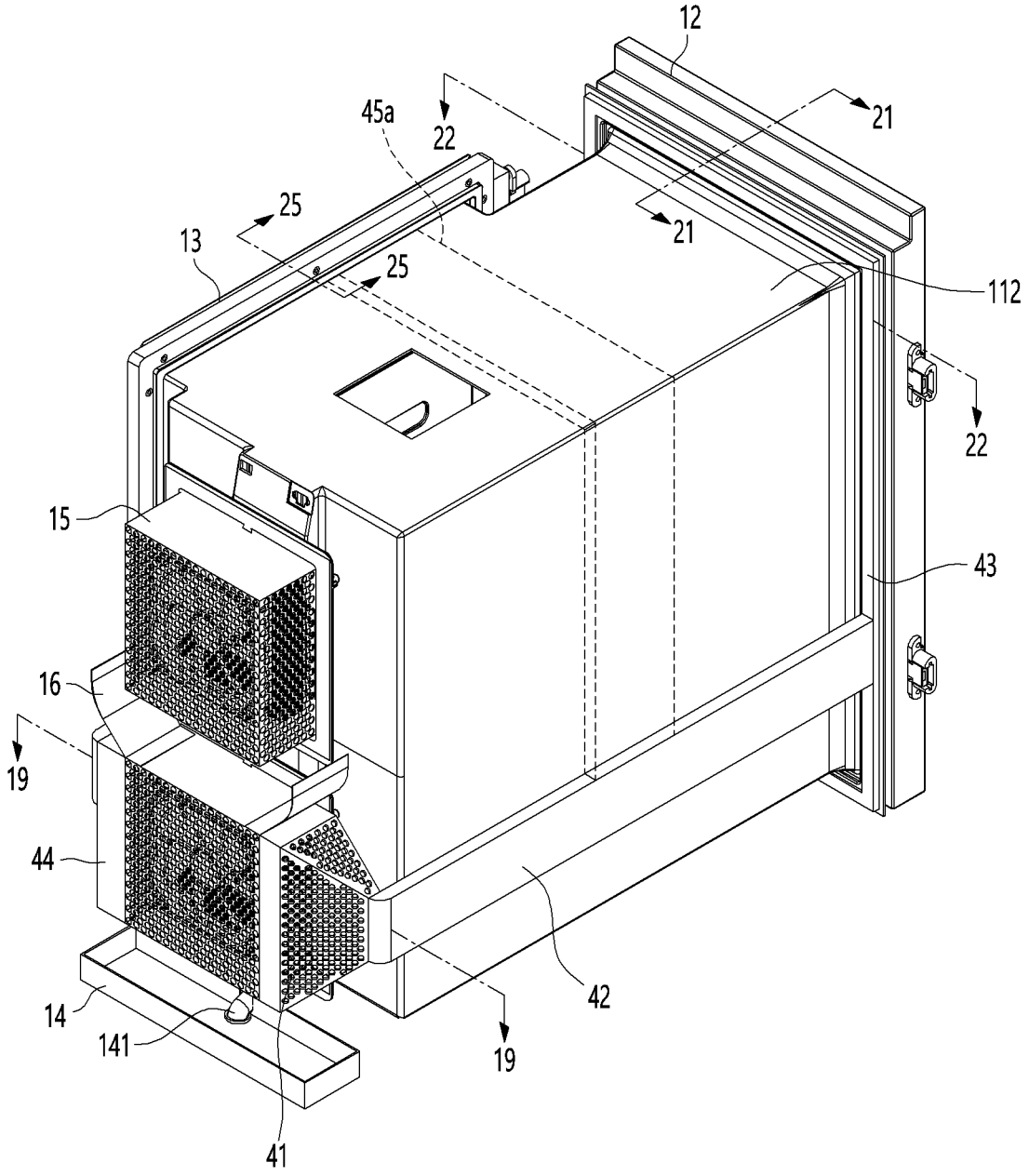
FIG. 18 is a rear perspective view of an entrance refrigerator without an outer case forming a cabinet.
Figure 19:
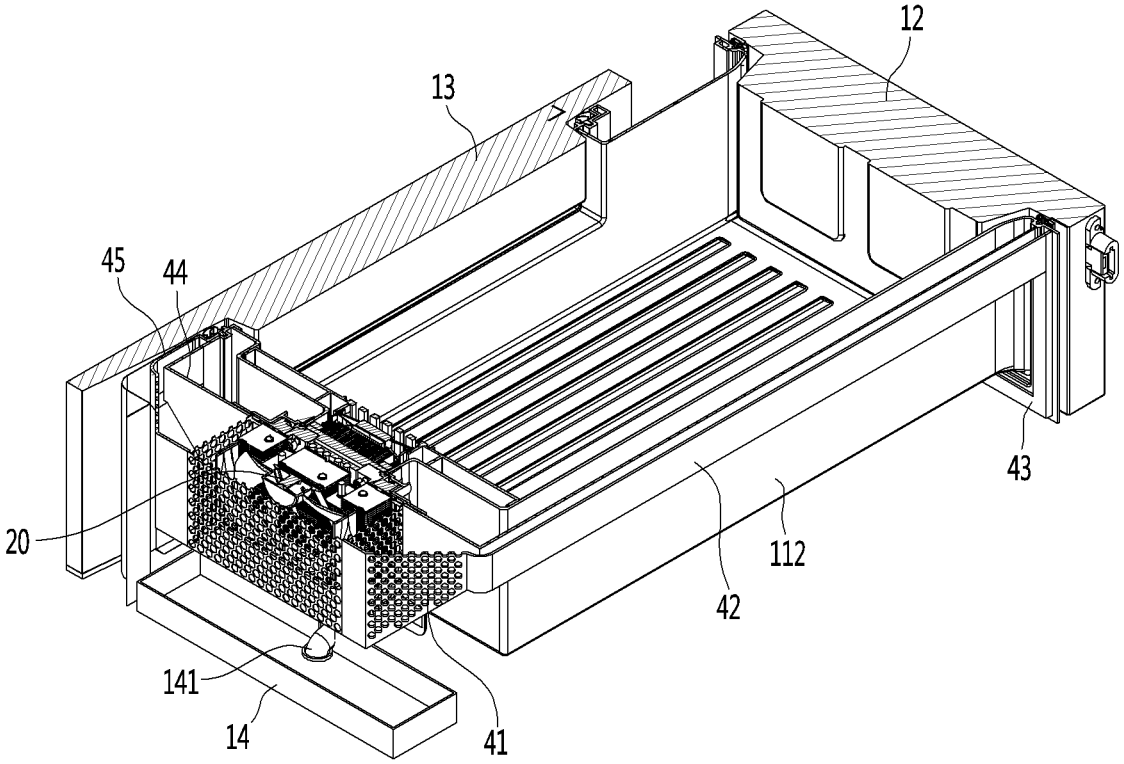
FIG. 19 is a cross-sectional perspective view of the entrance refrigerator, taken along line 19-19 of FIG. 18.

FIG. 17 is a rear perspective view of an entrance refrigerator including a condensation removal device 40 according to an embodiment of the present disclosure, FIG. 18 is a rear perspective view of an entrance refrigerator without an outer case forming a cabinet, and FIG. 19 is a cross-sectional perspective view of an entrance refrigerator, taken along line 19-19 of FIG. 18.

Referring to FIGS. 17 to 19, a condensation removal device 40 of an entrance refrigerator according to an embodiment of the present disclosure may include a guide duct extending from a side surface of the heat dissipation cover 15, a side duct extending from an end of the guide duct toward a front end of the cabinet 11, and a cover duct connected to an end of the side duct and coupled to the inner case 112 along a rear surface of the outer gasket 31 or the inner gasket 32.

For reference, a shielding member 19 may be provided at a rear end of one surface of the cabinet 11, specifically, at a rear end of the side surface with which the inner door 13 is in close contact. The shielding member 19 may extend in a length from an upper end to a lower end of the cabinet 11 and may be bent toward the other surface of the cabinet 11. That is, the shielding member 19 may have a bent portion at a rear side of the cabinet 11, wherein the bent portion forms an "L" shape.

The shielding member 19 is provided to minimize direct contact of hot air discharged through the side surface of the heat dissipation cover 15 when the inner door 13 is opened. Heat emitted from the heat dissipation cover 15 and hitting the shielding member 19 may rise along the shielding member 19, so that the amount of heat directly hitting the user who opens the inner door 13 may be reduced.

In detail, the guide duct includes a first guide duct 41 extending from one surface of the heat dissipation cover 15 and a second guide duct 44 extending from the other surface of the heat dissipation cover 15.

The side duct includes a first side duct 42 extending from an end of the first guide duct 41 toward the outer door 12, and a second side duct 45 extending from an end of the second guide duct 44 toward the inner door 13.

The cover duct includes a first cover duct 43 surrounding an edge of the outer gasket 31 and a second cover duct 46 surrounding an edge of the inner gasket 32. The first cover duct 43 is connected to an end of the first side duct 42 and the second cover duct 46 is connected to and end of the second side duct 45.

The side ducts 42 and 45 and the cover ducts 43 and 46 may be disposed between the outer case 111 and the inner case 112 and embedded in the heat insulating material 113.

The first guide duct 41 and the second guide duct 44 may be formed in a symmetrical shape with respect to a vertical plane but are not necessarily limited thereto. In addition, the first guide duct 41 and the second guide duct 44 may have a shape in which a width thereof narrows toward an end. This may increase a flow rate of heat flowing into the side duct so that heat is distributed throughout the cover ducts 43 and 46.

A plurality of heat dissipation holes are formed on a surface of the first guide duct 41 and the second guide duct 44, so that a part of heat dissipation air flowing through the first guide duct 41 and the second guide duct 44 may be discharged to the outside. This may be understood that a large amount of heat dissipation air is not required to prevent or remove condensation on the surface of the outer gasket 31 or the inner gasket 32.

Additionally, the second side duct 45 may extend from the second guide duct 44, or alternatively, as indicated by the dotted line in FIG. 18, the second guide duct 44 may be omitted and a second side duct 45*a* may be branched from a certain point of the first side duct 42 and extend to the second cover duct 46.

The second side duct 45*a* may extend along a side surface and an upper surface of the inner case 112 from a certain point of the first side duct 42 and may be connected to the second cover duct 46.

In addition, the side ducts 42 and 45 described in the present disclosure may be interpreted as including ducts extending along four sides, i.e., upper, lower, left and right surfaces of the inner case 112, excluding a front surface and a rear surface of the inner case.

Figure 20:
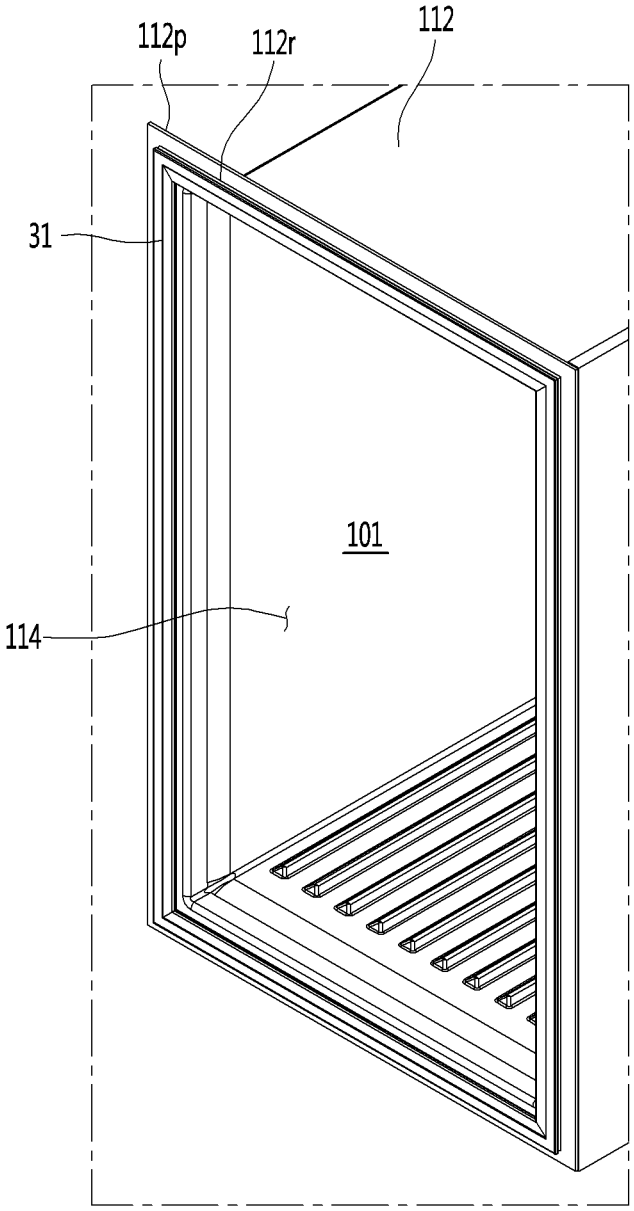
FIG. 20 is a partial perspective view showing a front surface of an inner case equipped with an outer gasket.
Figure 21:
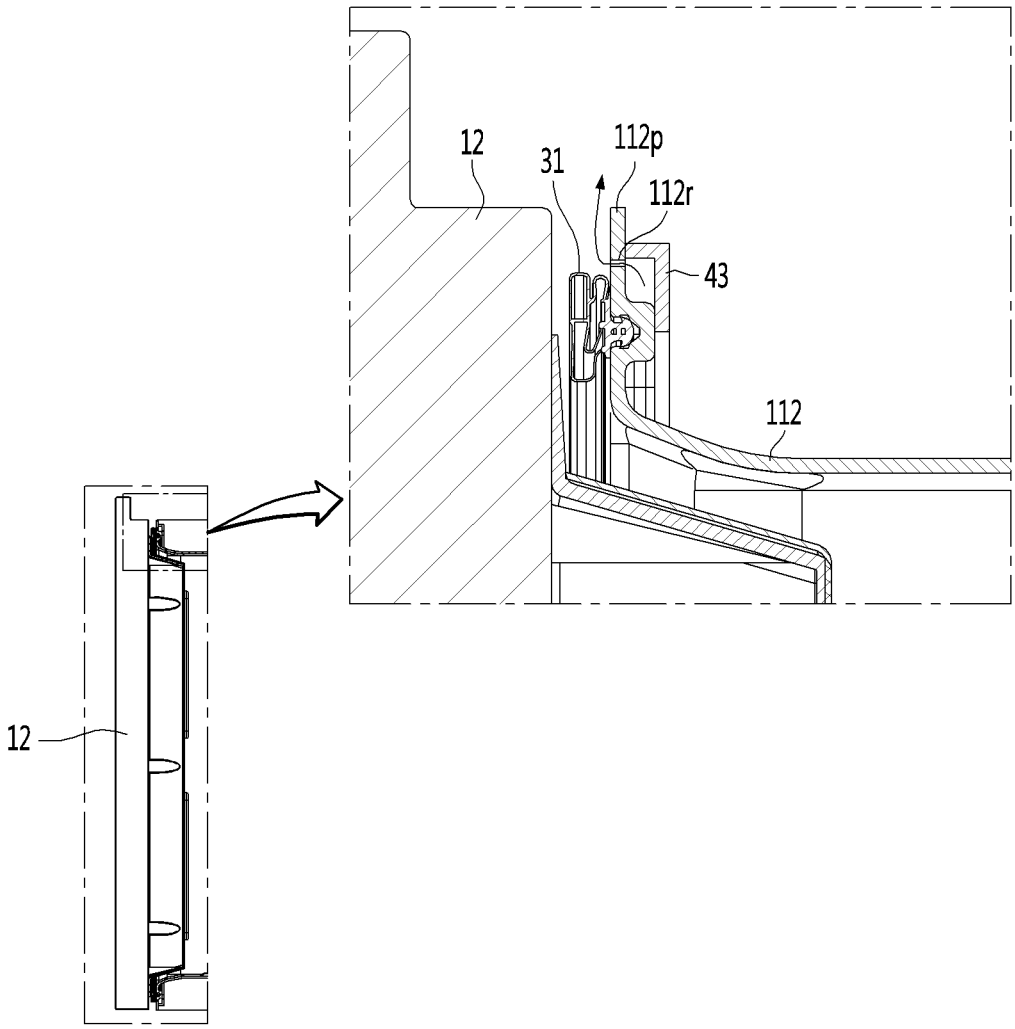
FIG. 21 is a longitudinal cross-sectional view of an inner case and an outer door, taken along line 21-21 of FIG. 18.
Figure 22:
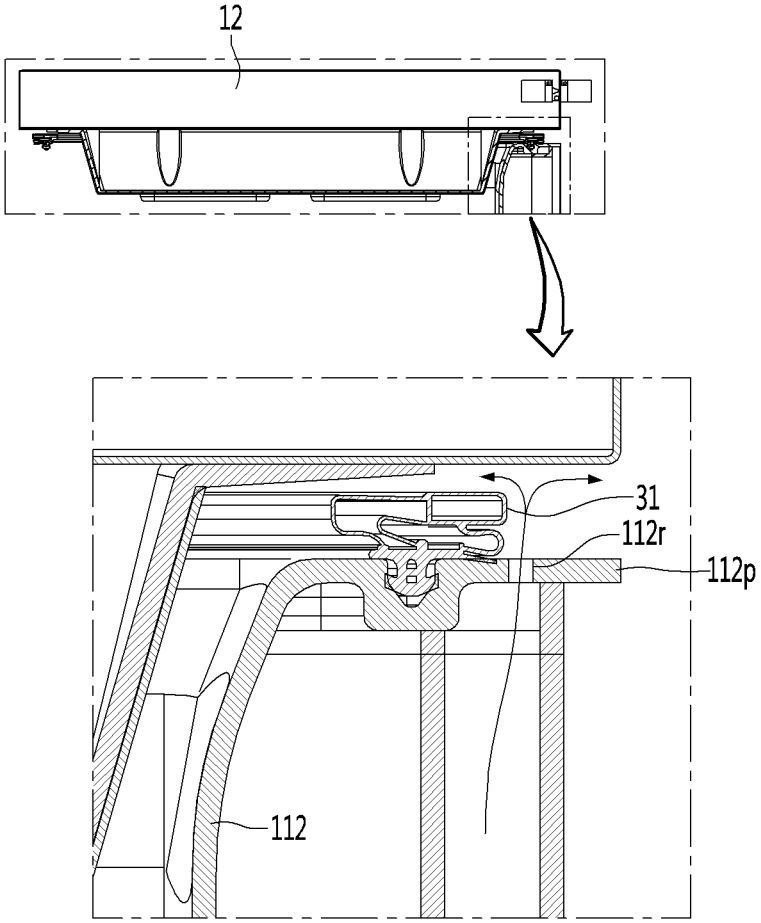
FIG. 22 is a cross-sectional view of an inner case and an outer door, taken along line 22-22 of FIG. 18.

FIG. 20 is a partial perspective view showing a front surface of the inner case 112 equipped with an outer gasket 31, FIG. 21 is a longitudinal cross-sectional view of the inner case 112 and the outer door 12, taken along line 21-21 of FIG. 18, and FIG. 22 is a cross-sectional view of the inner case 112 and outer door 12, taken along line 22-22 of FIG. 18.

Referring to FIGS. 20 to 22, the outer gasket 31 is mounted in the inner case 112.

Specifically, at the front end of the inner case 112, a flange 112*p* may be formed to extend vertically. Here, the flange 112*p* may be part of the inner case 112, or a separate member may be coupled to the front end of the inner case 112.

In addition, the flange 112*p* is formed with a fitting groove, and a fitting protrusion extending from a rear surface of the outer gasket 31 is inserted into the fitting groove. Also, in a state in which the outer gasket 31 is coupled to a front surface of the flange 112*p*, a plurality of air holes 112*r* may be arranged at an outer edge region of the outer gasket 31.

In addition, the first cover duct 43 surrounds along a rear surface of the flange 112*p*. The first cover duct 43 and the first side duct 42 are embedded by a heat insulating material 113 filled between the outer case 111 and the inner case 112.

By this structure, heat flowing along the first side duct 42 is discharged to the front of the cabinet 11 through the air holes 112*r*. The heat discharged through the air holes 112*r* flows to a space formed between the flange 112*p* and the rear surface of the outer door 12. In addition, the heat discharged to the space evaporates condensation formed on the surface of the outer gasket 31 and increases a surface temperature of the outer gasket 31 to block condensation formation.

Figure 23:
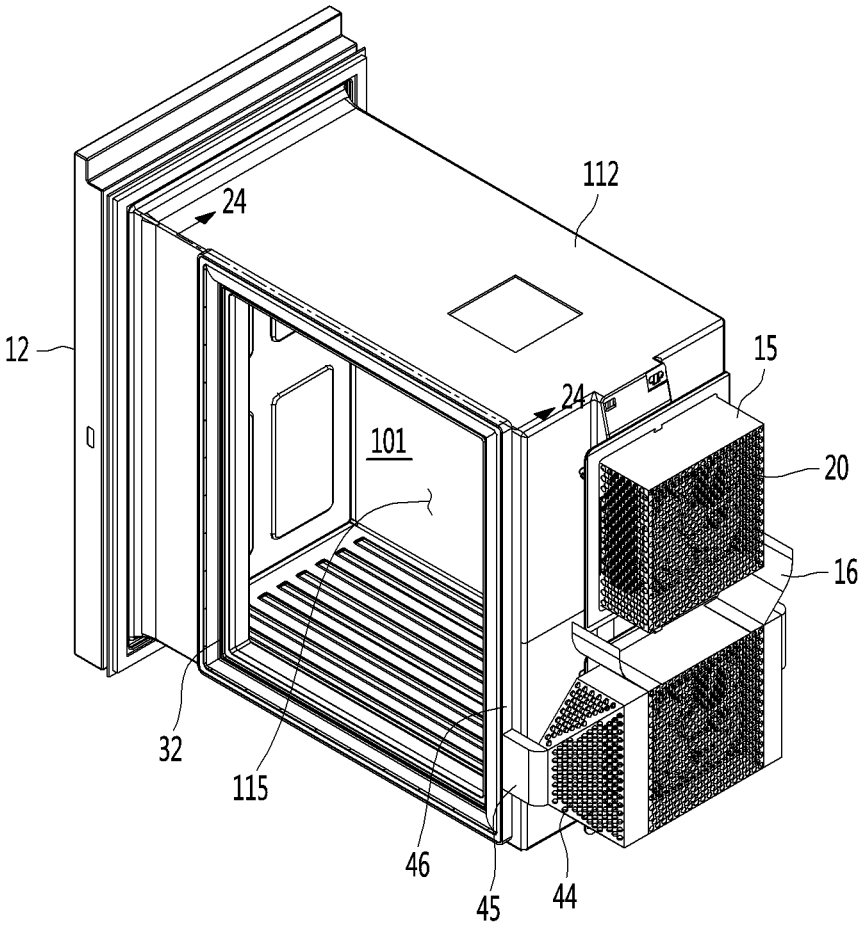
FIG. 23 is a rear perspective view of an entrance refrigerator without an inner door and an outer case of a cabinet according to an embodiment of the present disclosure.
Figure 24:
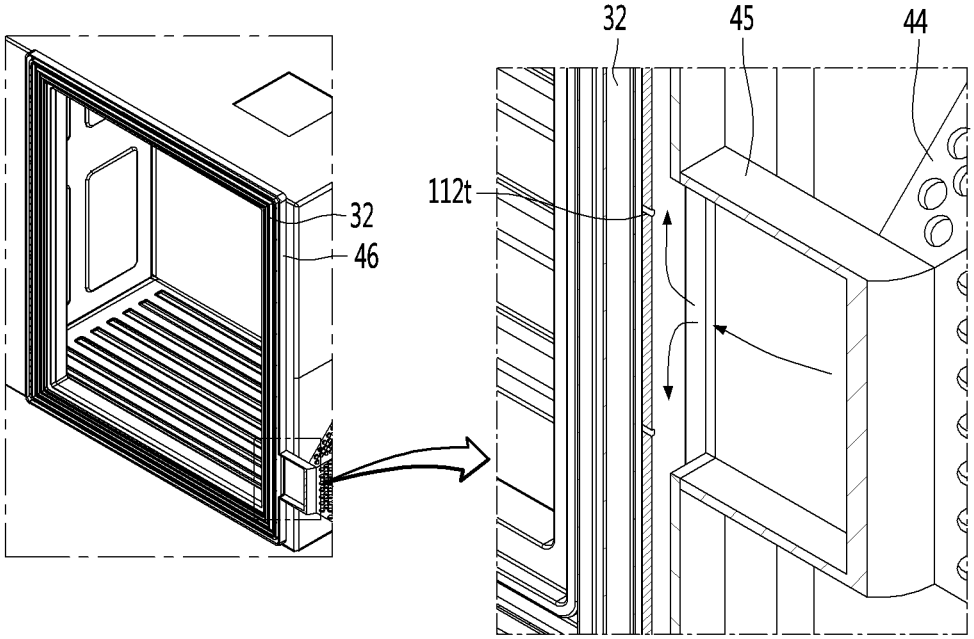
FIG. 24 is a longitudinal cross-sectional perspective view of an entrance refrigerator, taken along line 24-24 of FIG. 23.
Figure 25:
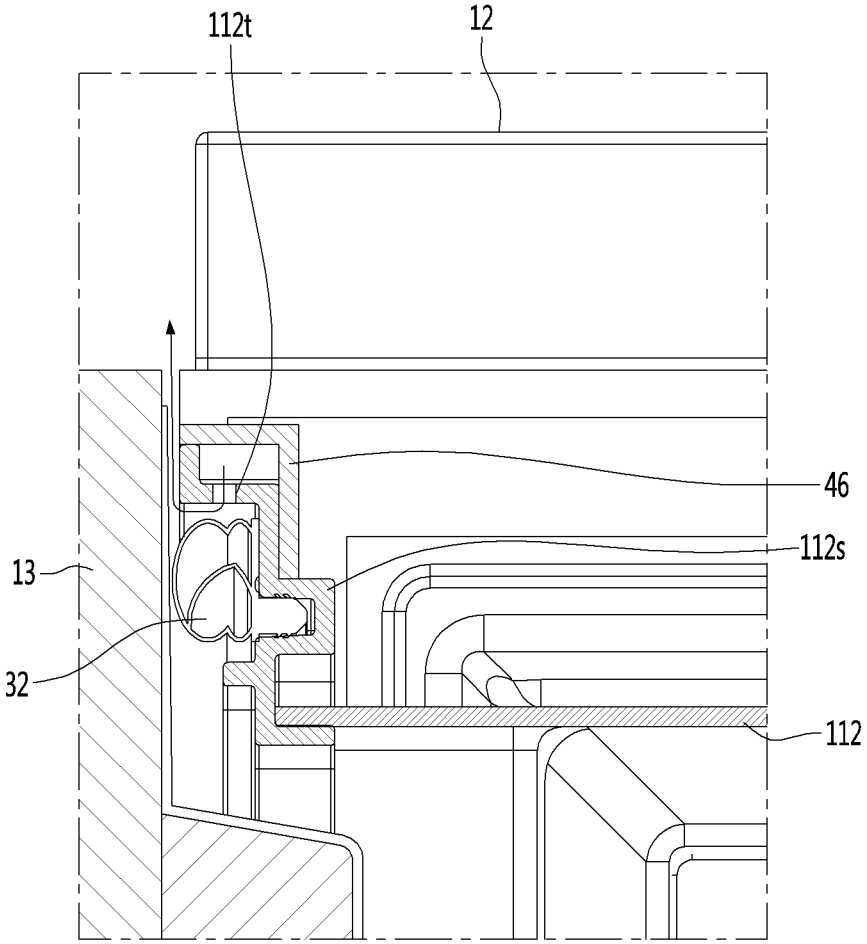
FIG. 25 is a longitudinal cross-sectional view of an entrance refrigerator, taken along line 25-25 of FIG. 18.
Figure 26:
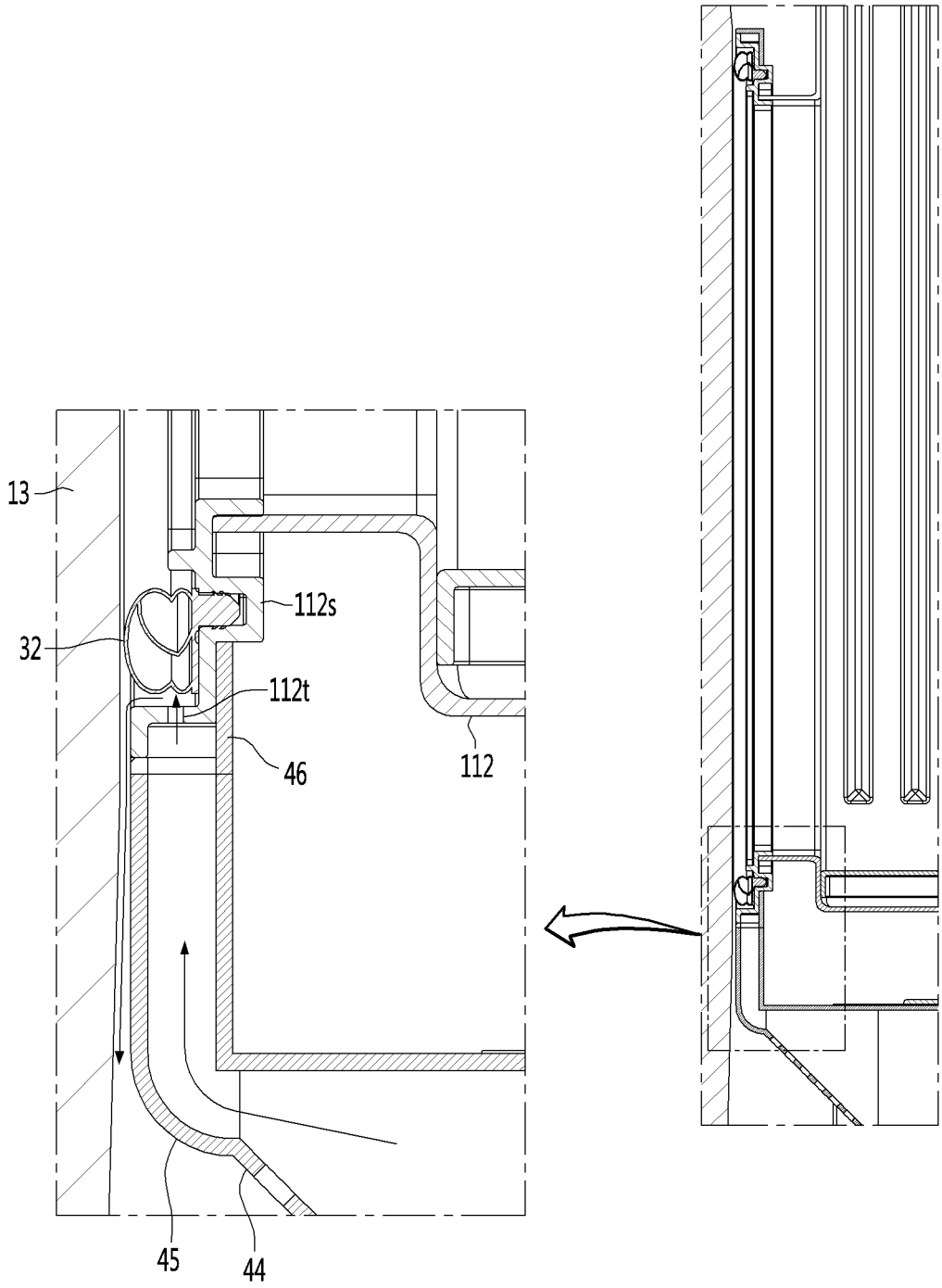
FIG. 26 is an enlarged partial cross-sectional view of an inner door portion of the cross-sectional perspective view of FIG. 19.

FIG. 23 is a rear perspective view of an entrance refrigerator without an inner door and an outer case of a cabinet according to an embodiment of the present disclosure, FIG. 24 is a longitudinal cross-sectional view of an entrance refrigerator, taken along line 24-24 of FIG. 23, FIG. 25 is a longitudinal cross-sectional perspective view of an entrance refrigerator, taken along line 24-24 of FIG. 23, and FIG. 26 is an enlarged partial cross-sectional view of an inner door portion in the longitudinal perspective cross-sectional view of FIG. 19.

Referring to FIGS. 23 to 26, the inner gasket 32 is mounted at the edge of the inner opening 115.

Specifically, a flange 112*s* may be formed at an end of the inner case 112 forming the inner opening 115, and the flange 112*s* may be a part of the inner case 112 or may be an independent member coupled to the inner case 112. The inner gasket 32 is mounted on the front surface of the flange 112*s*.

In addition, a plurality of air holes 112*t* may be arranged at any portion of the flange 112*s* corresponding to the outer edge of the inner gasket 32.

More specifically, the second cover duct 46 surrounds the air holes 112*t* on the rear surface of the flange 112*s*. By this structure, the heat dissipation air flowing along the second guide duct 44, the second side duct 45, and the cover duct 46 is discharged through the air holes 112*t* and hits the inner gasket 32. The heat hitting the inner gasket 32 evaporates condensation formed on the surface of the inner gasket 32.

Air evaporating condensation formed on the surface of the inner gasket 32 is discharged to the outside of the entrance refrigerator 10 through a gap formed between the rear surface of the inner door 13 and the front surface of the cabinet 11.

The flange 112*p* formed in the outer opening may be defined as a first flange, and the flange 112*s* formed in the inner opening may be defined as a second flange.

The air hole 112*r* formed at the first flange may be defined as a first air hole, and the air hole 112*t* formed at the second flange may be defined as a second air hole.

The outer gasket 31 may be defined as a first gasket, and the inner gasket 32 may be defined as a second gasket.

It will be apparent to those skilled in the art that various modifications and variations may be made in the present disclosure without departing from the spirit or scope of the disclosures. Thus, it is intended that the present disclosure covers the modifications and variations of this disclosure provided they come within the scope of the appended claims and their equivalents.

What is claimed is:

1. An entrance refrigerator, comprising:

a cabinet including:

a first opening on a first surface;

a second opening on a second surface; and a storage space to receive an article, wherein the cabinet is configured to be embedded in a partition between a first space and a second space;

a first door configured to selectively open and close the first opening and be exposed to the second space;

a second door configured to selectively open and close the second opening and be exposed to the first space;

a first gasket surrounding edges of the first opening to seal the first door;

a second gasket surrounding edges of the second opening to seal the second door;

a cold air supply assembly installed to the cabinet by passing through a rear wall of the cabinet facing the first opening to supply cold air to the storage space;

a heat dissipation cover covering the cold air supply assembly and coupled to the rear surface of the cabinet; and a condensation removal device having a first side connected to the heat dissipation cover and a second side surrounding at least one of the edges of the first opening and the edges of the second opening, the condensation removal device being configured to supply heat dissipation air generated in the cold air supply assembly to at least one of the first gasket and the second gasket, wherein the cold air supply assembly includes:

a thermoelectric element having an endothermic surface and an exothermic surface;

a cold sink attached to the endothermic surface of the thermoelectric element and facing the storage space;

a heat sink attached to the exothermic surface of the thermoelectric element and disposed at an outside of the cabinet;

a heat absorption fan placed in front of the cold sink;

a heat dissipation fan placed behind the heat sink; and an insulation block surrounding the edges of the thermoelectric element, wherein the heat dissipation cover includes:

a front surface which is opened, an edge of the front surface being in contact with a rear surface of the rear wall of the cabinet;

an upper side surface;

a lower side surface facing the upper side surface;

a first side surface;

a second side surface facing the first side surface; and a rear surface facing the front surface and connecting rear edges of the side surfaces, wherein the first and second side surfaces and the rear surface of the heat dissipation cover have dissipation holes to introduce indoor air to the heat sink, wherein the condensation removal device includes:

a first guide duct extending from the first side surface of the heat dissipation cover;

a first side duct extending from the first guide duct to the first opening; and a first cover duct surrounding the edges of the first opening from an end of the first side duct, wherein a longitudinal section area of the first guide duct becomes narrower from the first side surface of the heat dissipation cover towards the first side duct, and wherein the first guide duct has heat dissipation holes such that a portion of the air exhausted from the heat dissipation cover is discharged to the first space before being introduced into the first side duct.

2. The entrance refrigerator of claim 1, wherein the cabinet further includes:

an inner case having a first end defining the first opening;

an outer case coupled to an outer side of the inner case; and insulation between the inner case and the outer case, wherein the first side duct and the first cover duct are arranged between the outer case and the inner case.

3. The entrance refrigerator of claim 2, wherein the first side duct extends from the first guide duct to the first door, and wherein the first side duct and the first cover duct are provided within the insulation.

4. The entrance refrigerator of claim 2, wherein the inner case includes a first flange perpendicular to the first end of the inner case that defines the first opening, and wherein the first flange includes a plurality of first air holes.

5. The entrance refrigerator of claim 4, wherein the first cover duct surrounds a rear surface of the first flange to cover the plurality of first air holes.

6. The entrance refrigerator of claim 4, wherein the first gasket is mounted on a front surface of the first flange and between the first opening and the plurality of first air holes.

7. The entrance refrigerator of claim 2, wherein the condensation removal device comprises:

a second guide duct extending from a second side of the heat dissipation cover, the second side of the heat dissipation cover being opposite to the first side of the heat dissipation cover;

a second side duct extending from the second guide duct; and a second cover duct connected to an end of the second side duct.

8. The entrance refrigerator of claim 7, wherein the inner case includes:

a second end defining the second opening; and a second flange perpendicular to the second end of the inner case that defines the second opening, and wherein the second flange includes a plurality of second air holes.

9. The entrance refrigerator of claim 8, wherein the second cover duct surrounds a rear surface of the second flange to cover the plurality of second air holes, and wherein the second gasket is mounted on a front surface of the second flange corresponding to a region between the second opening and the plurality of second air holes.

10. The entrance refrigerator of claim 1, further comprising a shielding member provided at a rear end of a side surface of the cabinet in which the second opening is provided, wherein the shielding member extends from an upper end of the cabinet to a lower end of the cabinet and is bent toward the center of the rear surface of the cabinet.

* * * * *